US008066361B2

(12) United States Patent
Miyajima et al.

(10) Patent No.: US 8,066,361 B2
(45) Date of Patent: Nov. 29, 2011

(54) LIQUID DELIVERY SYSTEM AND MANUFACTURING METHOD FOR THE SAME

(75) Inventors: Chiaki Miyajima, Matsumoto (JP); Satoshi Shinada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 216 days.

(21) Appl. No.: 12/404,865

(22) Filed: Mar. 16, 2009

(65) Prior Publication Data

US 2009/0237473 A1 Sep. 24, 2009

(30) Foreign Application Priority Data

Mar. 21, 2008 (JP) ..... 2008-073344

(51) Int. Cl.
*B41J 2/175* (2006.01)
*B41J 2/195* (2006.01)
*B41J 29/393* (2006.01)

(52) U.S. Cl. ..... 347/86; 347/7; 347/19

(58) Field of Classification Search ..... 347/85
See application file for complete search history.

(56) References Cited

U.S. PATENT DOCUMENTS

| | | | |
|---|---|---|---|
| 6,536,861 | B1 | 3/2003 | Usui et al. |
| 7,175,244 | B2 | 2/2007 | Usui et al. |
| 7,281,776 | B2 | 10/2007 | Usui et al. |
| 7,344,231 | B2 | 3/2008 | Talon et al. |
| 7,686,436 | B2 | 3/2010 | Jung et al. |
| 2002/0129649 | A1 | 9/2002 | Kim et al. |
| 2003/0117451 | A1 | 6/2003 | Usui et al. |
| 2005/0073558 | A1 | 4/2005 | Wouters et al. |
| 2005/0243110 | A1 | 11/2005 | Takahashi et al. |
| 2006/0001714 | A1 | 1/2006 | Usui et al. |
| 2007/0040877 | A1 | 2/2007 | Kachi |
| 2008/0036805 | A1 * | 2/2008 | Shinada et al. ..... 347/9 |

FOREIGN PATENT DOCUMENTS

| | | | |
|---|---|---|---|
| EP | 1 792 734 | A2 | 6/2007 |
| GB | 2 440 837 | A | 2/2008 |
| JP | 2006-248201 | A | 9/2006 |
| JP | 2006-305942 | A | 11/2006 |
| JP | 2007-185940 | A | 7/2007 |
| JP | 2007-245701 | A | 9/2007 |
| KR | 10-0541254 | A | 4/2003 |
| KR | 10-0675982 | B1 | 1/2007 |

* cited by examiner

*Primary Examiner* — Stephen Meier
*Assistant Examiner* — Tracey McMillion

(57) ABSTRACT

The liquid delivery system includes a liquid receptacle (1) installable on the liquid jetting device, a liquid supply device (900), and a liquid flow passage member (910). The liquid receptacle (1) has a liquid storage chamber for storing liquid, an air flow passage connecting the liquid storage chamber to the outside air, a liquid delivery port for delivering the liquid to the liquid jetting device, an intermediate flow passage leading from the liquid storage chamber to the liquid delivery port, and a sensor disposed in the intermediate flow passage to sense whether the liquid is present or not. The liquid storage chamber includes a top storage chamber that is located at an uppermost position in the liquid storage chamber. The intermediate flow passage has a buffer chamber disposed downstream of the sensor, at a location adjacent to the top storage chamber. The liquid flow passage member (910) is connected to the top storage chamber, and a communication hole is formed in a wall that lies between the top storage chamber and the buffer chamber.

7 Claims, 20 Drawing Sheets

LIQUID DELIVERY SYSTEM AND MANUFACTURING METHOD FOR THE SAME

CROSS-REFERENCE TO RELATED APPLICATIONS

The present application claims the priority based on Japanese Patent Application No. 2008-73344 filed on Mar. 21, 2008, the disclosure of which is hereby incorporated by reference in its entirety.

BACKGROUND OF THE INVENTION

1. Field of the Invention

The present invention relates to a liquid delivery system for delivering liquid to a liquid jetting device, and to a method of manufacturing the same.

2. Description of the Related Art

Ink-jet printers are an example of one known class of liquid jetting device. In an ink-jet printer, ink is delivered from one or more ink cartridges. In one known conventional technology, a large-capacity ink tank is provided outside of the ink-jet printer and is connected by a tube to an ink cartridge in the printer, thereby increasing the ink storage capacity.

However, depending on the type of ink cartridge, simply connecting a tube to the ink cartridge may result in loss of ink cartridge functionality, with a possibility that ink will not be delivered appropriately to the print head of the printer. This problem is not limited to ink-jet printers, but is a problem that is common generally to liquid jetting devices or liquid-consuming devices installable of liquid receptacles.

SUMMARY OF THE INVENTION

An object of the present invention is to provide technology for appropriate delivery of liquid to a liquid jetting device that accommodates installation of a liquid receptacle.

According to an aspect of the present invention, there is provided a method of manufacturing a liquid delivery system that delivers liquid to a liquid jetting device. The method includes the steps of: (a) providing a liquid receptacle that is installable on the liquid jetting device; (b) providing a liquid supply device that supplies the liquid receptacle with the liquid; and (c) connecting the liquid receptacle and the liquid supply device with a liquid flow passage member. The liquid receptacle has a liquid storage chamber that stores the liquid; an air flow passage the connects the liquid storage chamber to an outside air; a liquid delivery port that delivers the liquid to the liquid jetting device; an intermediate flow passage leading from the liquid storage chamber to the liquid delivery port; and a sensor, disposed in the intermediate flow passage, for sensing whether the liquid is present or not. The liquid storage chamber includes a top storage chamber which is located at an uppermost position in the liquid storage chamber. The intermediate flow passage has a buffer chamber disposed downstream of the sensor, at a location adjacent to the top storage chamber, The step (c) includes the steps of: (i) connecting the liquid flow passage member to the top storage chamber; and (ii) forming a communication hole in a wall that lies between the top storage chamber and the buffer chamber. Typically, within the entire liquid flow passage, the flow passage resistance will be high at the location of the sensor which has been disposed in the intermediate flow passage. Consequently, if the liquid flow passage member is connected to the upstream side of the sensor, it is possible that replenishing liquid supplied from the liquid supply device to the liquid flow passage member will not be delivered sufficiently to the liquid jetting device, due to the high flow passage resistance at the sensor location. According to the above configuration on the other hand, because the liquid is introduced via the top storage chamber into the buffer chamber which is disposed downstream of the sensor, it is possible for replenishing liquid supplied from the liquid supply device via the liquid flow passage member to be delivered appropriately to the liquid jetting device.

The air flow passage may include a top air flow passage disposed adjacently above the top storage chamber, and the liquid flow passage member may pass through an outside wall of the top air flow passage and through another wall between the top air flow passage and the top storage chamber, to connect with the top storage chamber. This configuration will facilitate the connection operation because the operation will be done through pushing the liquid flow passage member through only two walls and connecting the passage member to the top storage chamber.

The step (i) may include sealing together the outside wall of the top air flow passage and the liquid flow passage member, and the method may further comprise closing off the air flow passage at a location upstream of a passing location where the liquid flow passage member passes through the top air flow passage. This configuration will prevent air (air bubbles) from flowing into the sensor, thereby preventing malfunction of the sensor.

The step (i) may include sealing together the liquid flow passage member, and a wall lying between the top air flow passage and the top storage chamber, and the method may further comprise closing off the air flow passage at a location downstream of a passing location where the liquid flow passage member passes through the top air flow passage. This configuration will also prevent air (air bubbles) from flowing into the sensor, thereby preventing malfunction of the sensor.

The step (i) may includes: cutting away a part of an outside wall of the top air flow passage such that the cut-away part is larger than a cross section of the liquid flow passage member; forming an opening in a wall that lies between the top air flow passage and the top storage chamber; fastening a coupling into the opening and sealing together the coupling and the opening; and connecting the liquid flow passage member to the coupling. With this configuration, the cut-away of a large area of the outside wall of the top air flow passage will facilitate the connection operation.

There are various possible modes of working the present invention, including but not limited to a liquid delivery system and a method of manufacturing the same; a liquid receptacle for use in a liquid delivery system and a method of manufacturing the same; and a liquid jetting device or a liquid consuming device, for example.

DESCRIPTION OF THE PREFERRED EMBODIMENT

The embodiments of the present invention will be described in the order indicated below.

A. Overall Configuration of Ink Delivery System

B. Basic Configuration of Ink Cartridge

Figure 1A:
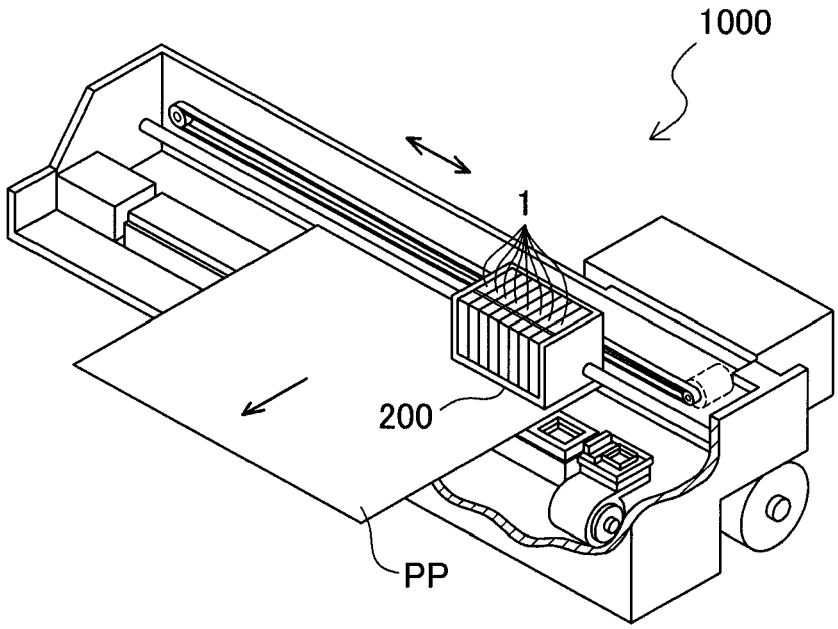
FIGS. 1A and 1B show an example of an on-cartridge type ink-jet printer and an ink delivery system employing the same.

C. Configuration of Ink Cartridge for Use in Ink Delivery System and Method of Manufacturing the Same D. Modified Examples A. Overall Configuration of Ink Delivery System FIG. 1A is a perspective view depicting an exemplary ink-jet printer. This ink-jet printer 1000 has a carriage 200 that travels in the main scanning direction, as well as a feed mechanism for feeding printing paper PP in the sub-scanning direction. A print head (not shown) is disposed at the lower end of the carriage 200, and this print head is used to carry out printing on the printing paper PP. A cartridge housing capable of accommodating multiple ink cartridges 1 is provided on the carriage 200. This kind of printer, in which the ink cartridges are installed on the carriage, is termed an "on-carriage type printer."

Figure 1B:
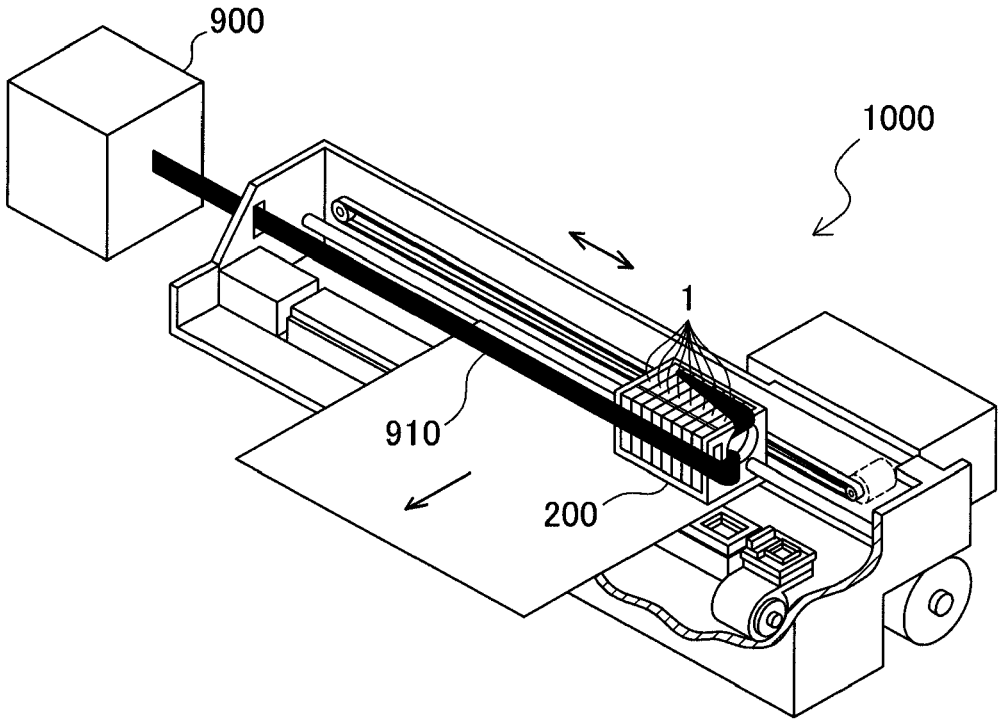

FIG. 1B depicts an ink delivery system that employs this ink-jet printer 1000. In this system, large-capacity ink tank 900 is provided externally to the ink-jet printer 1000, with the large-capacity ink tank 900 and the ink cartridges 1 being connected by ink supply tubes 910. The large-capacity ink tank 900 contains ink receptacles equal in number to the number of ink cartridges 1. By providing this additional large-capacity ink tank 900, the ink storage capacity of the printer can be substantially increased appreciably. The large-capacity ink tank 900 is also referred to as an "external ink tank."

Figure 2A:
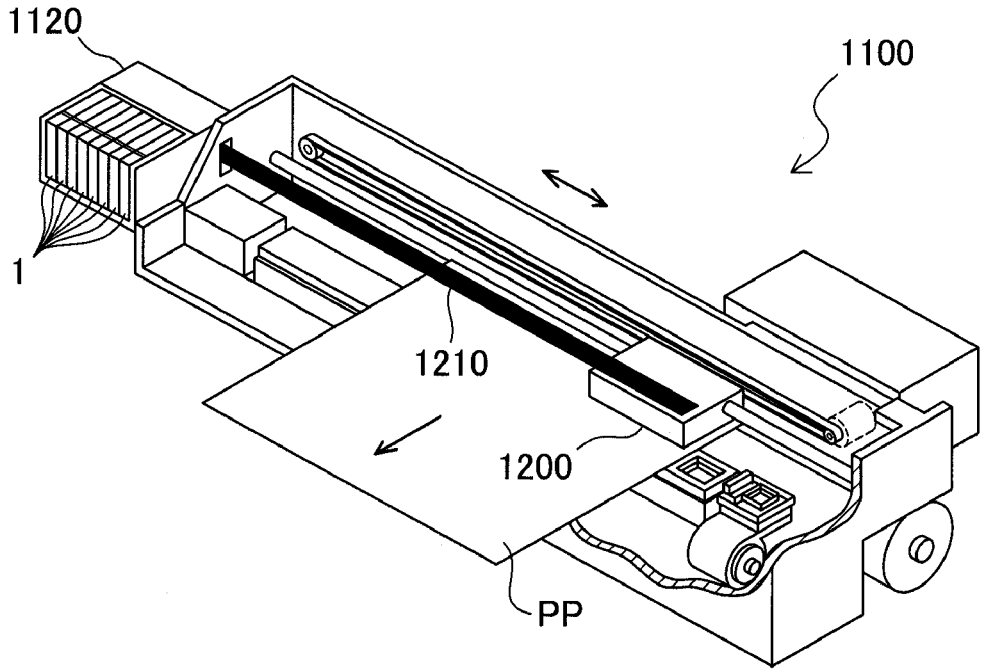
FIGS. 2A and 2B show an example of an off-cartridge type ink-jet printer and an ink delivery system employing the same.

FIG. 2A is a perspective view depicting another exemplary ink-jet printer. In this ink-jet printer 1110, the ink cartridges are not installed on the carriage 1200, but rather are disposed in a cartridge housing 1120 to the outside of the printer chassis (to the outside of the range of travel of the carriage). The ink cartridges 1 and the carriage 1200 are connected by ink delivery tubes 1210. This kind of printer, in which the ink cartridges are installed at a location other than the carriage, is termed an "off-carriage type printer."

Figure 2B:
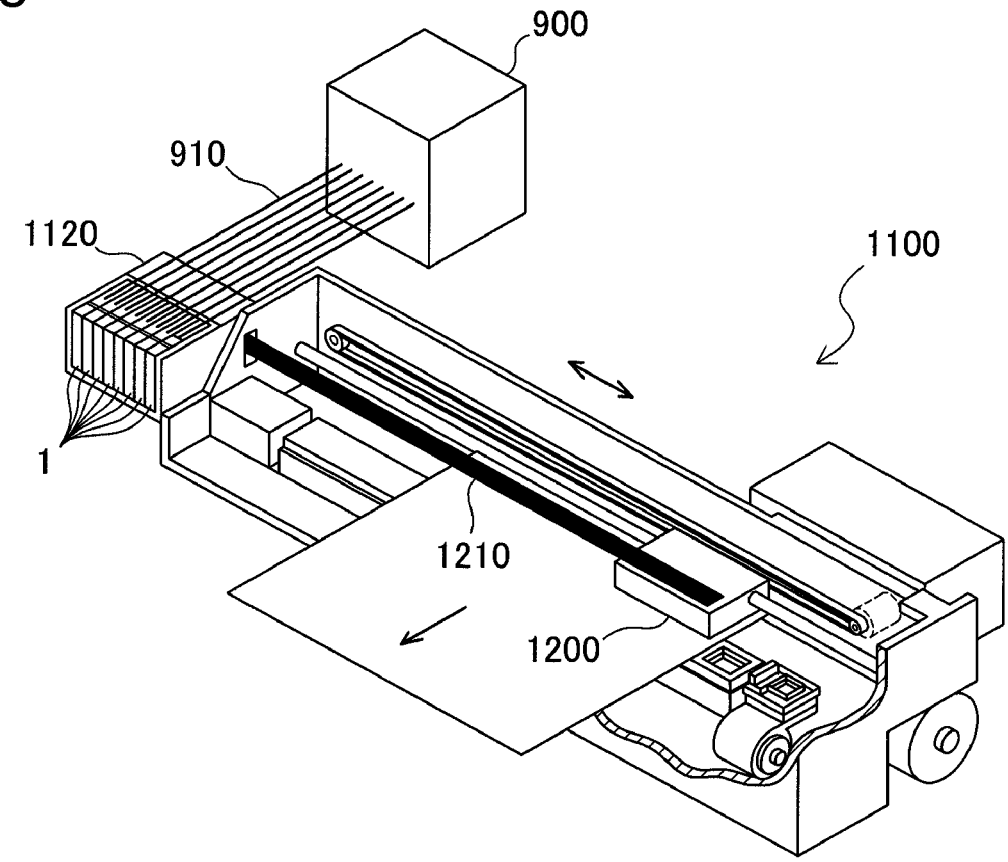

FIG. 2B depicts an ink delivery system that employs this ink-jet printer 1100. In this system, an additional large-capacity ink tank 900 is provided, and the large-capacity ink tank 900 and the ink cartridges 1 are connected by ink supply tubes 910. Thus, for this type of off-carriage printer as well, by the same method as with the on-carriage type printer it will be possible to design an ink delivery system having appreciably larger ink storage capacity.

Herein the system composed of the ink cartridges 1, the large-capacity ink tank 900, and the ink supply tubes 910 will be referred to as the "ink delivery system." In some instances, the entire system inclusive of the ink-jet printer will be referred to as the "ink delivery system."

Following is a description first of the design of the ink cartridges that are utilized in the embodiments of the ink delivery system herein; followed by a description of the detailed configuration of the ink delivery system and of a method for manufacturing it. While the following description relates for the most part to the use of an on-carriage type printer, the specifics thereof are applicable analogously to an ink-jet printer of off-carriage type.

B. Basic Configuration of Ink Cartridge

Figure 3:
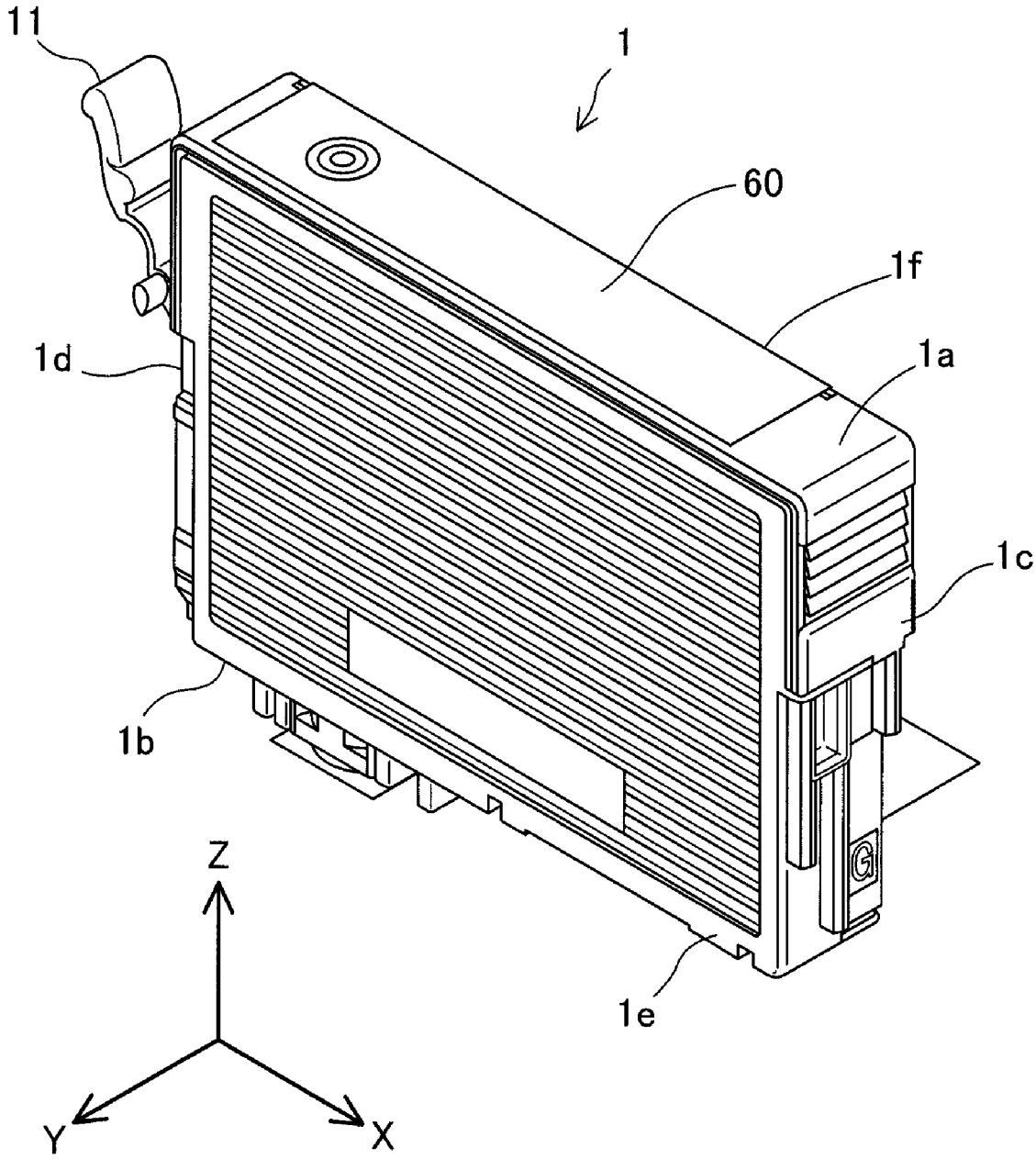
FIG. 3 is a first external perspective view of an ink cartridge.
Figure 4:
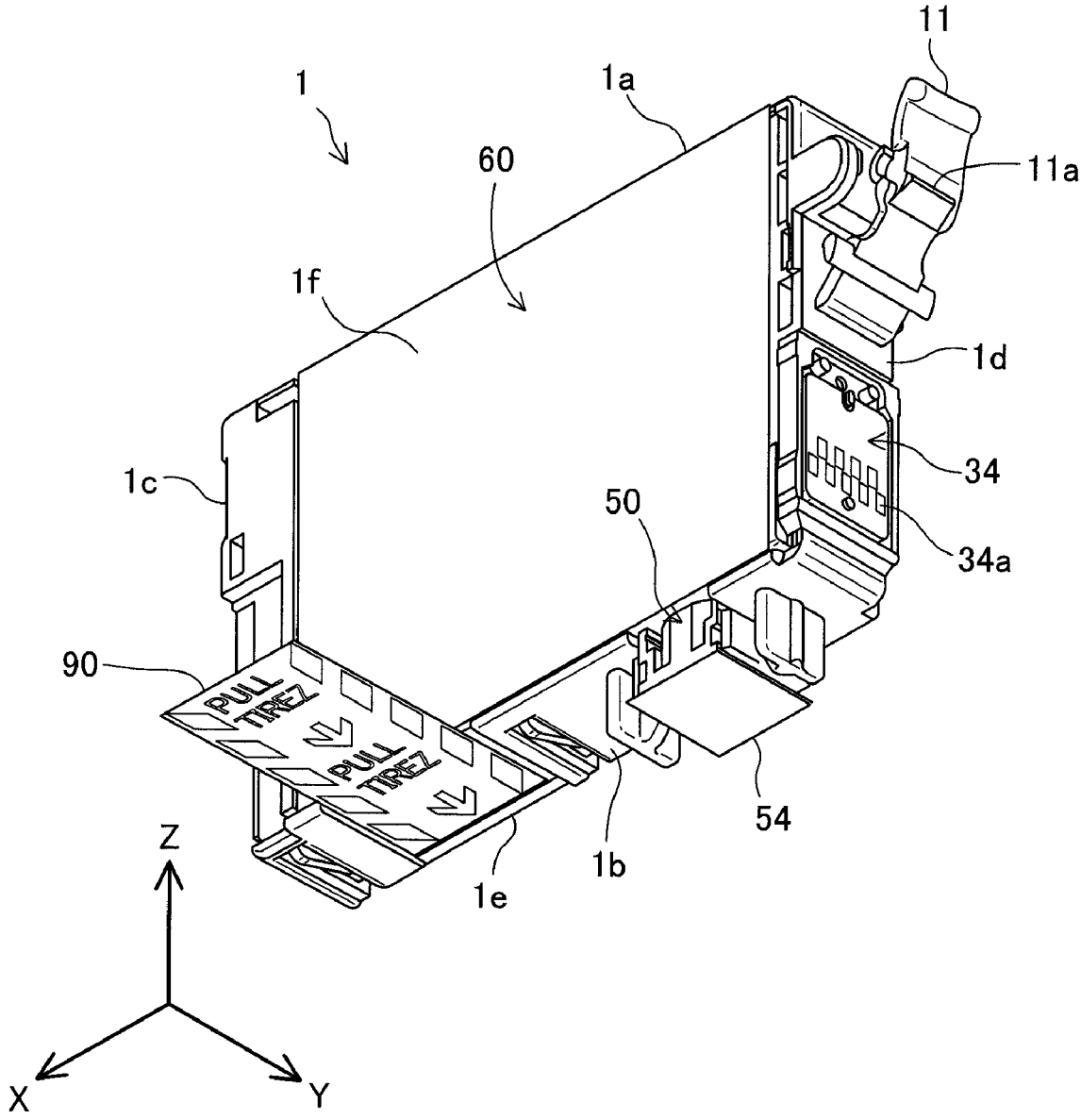
FIG. 4 is a second external perspective view of an ink cartridge.
Figure 5:
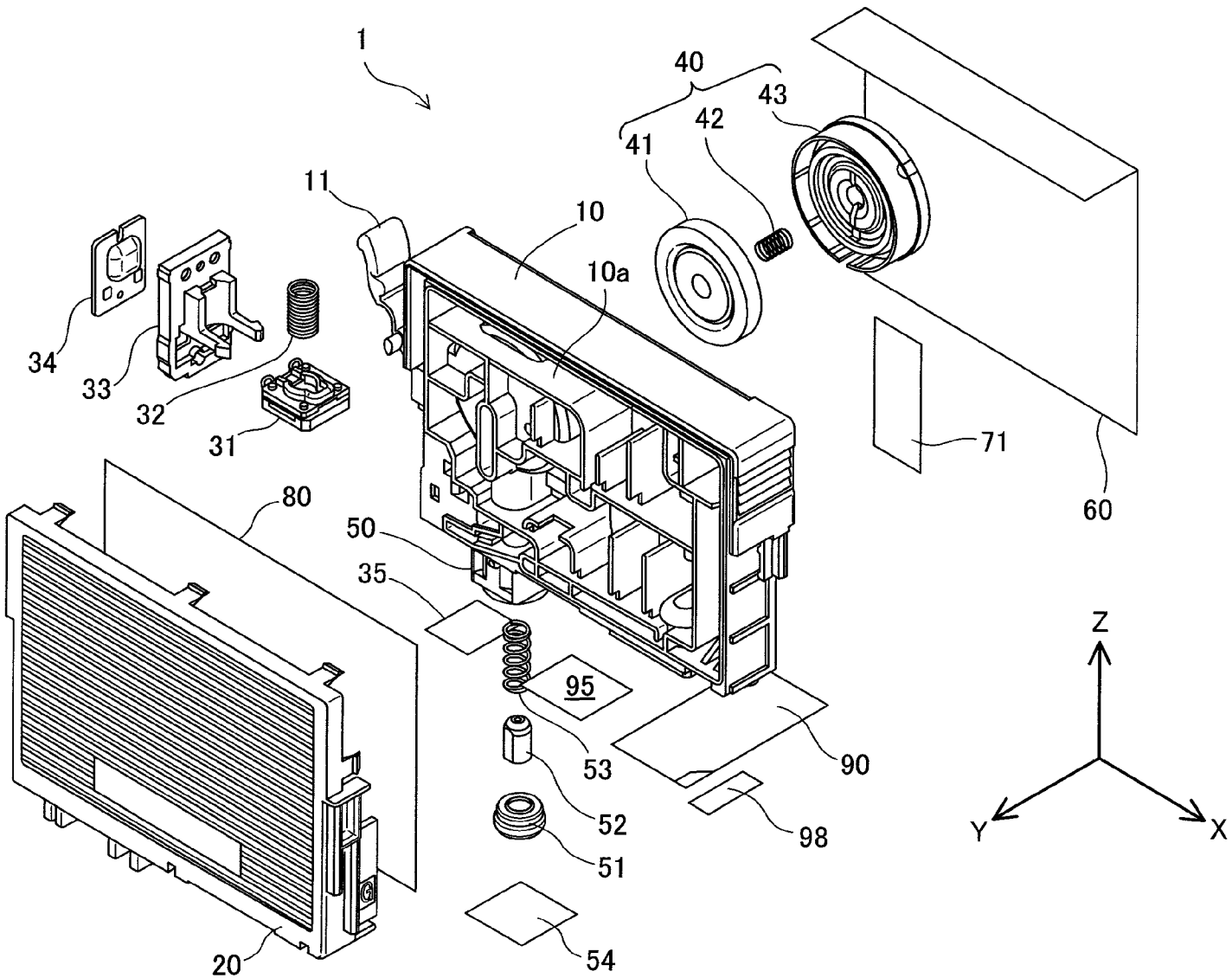
FIG. 5 is a first exploded perspective view of an ink cartridge.
Figure 6:
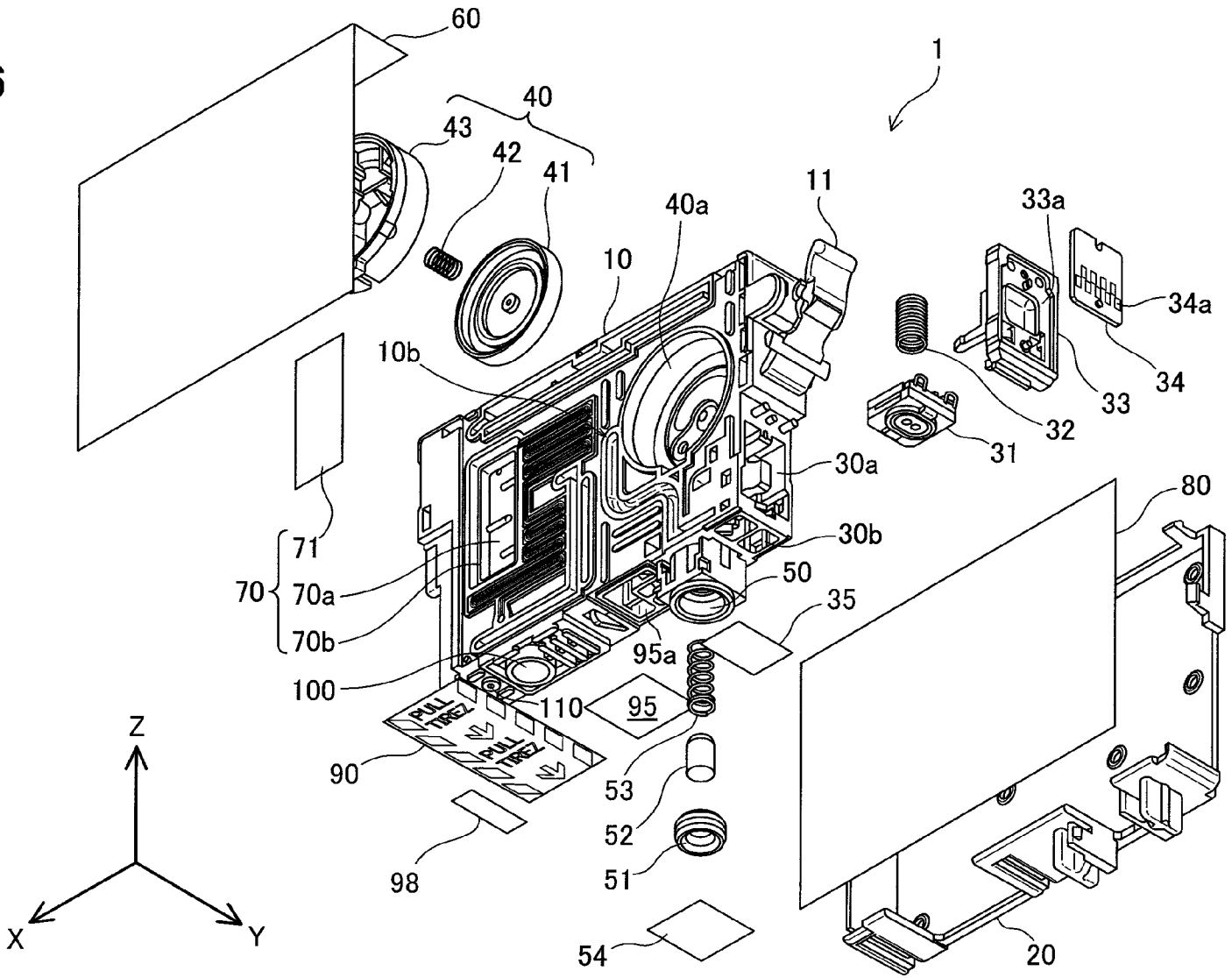
FIG. 6 is a second exploded perspective view of an ink cartridge.
Figure 7:
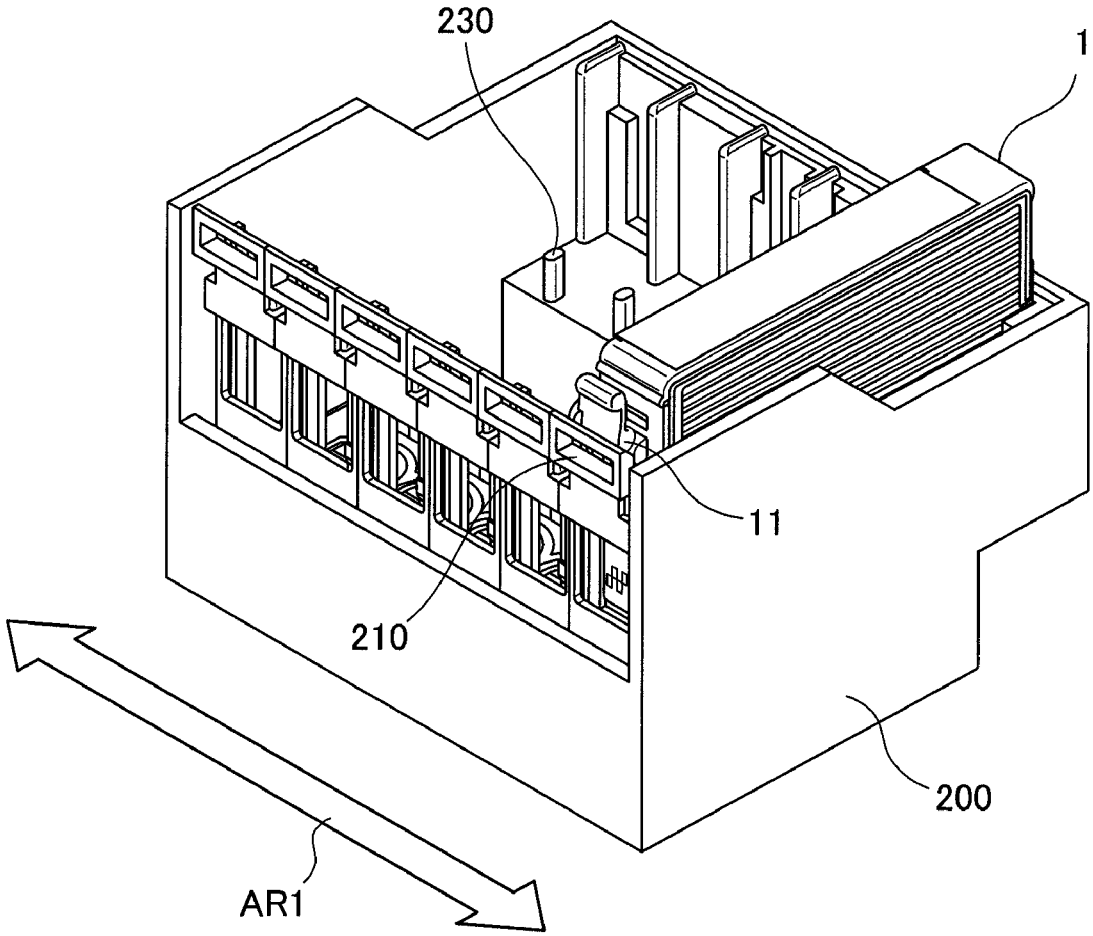
FIG. 7 is a drawing depicting an ink cartridge installed on a carriage.

FIG. 3 is a first external perspective view of an ink cartridge. FIG. 4 is a second external perspective view of an ink cartridge. FIG. 4 depicts the cartridge of FIG. 3 viewed from the opposite direction. FIG. 5 is a first exploded perspective view of an ink cartridge. FIG. 6 is a second exploded perspective view of an ink cartridge. FIG. 6 depicts the cartridge of FIG. 5 viewed from the opposite direction. FIG. 7 depicts an ink cartridge installed in the carriage 200. In FIGS. 3 to 6, the X, Y, and Z axes are shown in order to identify direction.

The ink cartridge 1 stores liquid ink inside. As depicted in FIG. 7, the ink cartridge 1 is installed on the carriage 200 of the ink-jet printer, and delivers ink to the print head of the ink-jet printer.

As depicted in FIGS. 3 and 4, the ink cartridge 1 has generally rectangular parallelepiped contours, and has a Z-axis positive direction face 1*a*, a Z-axis negative direction face 1*b*, an X-axis positive direction face 1*c*, an X-axis negative direction face 1*d*, a Y-axis positive direction face 1*e*, and a Y-axis negative direction face 1*f*. For convenience, hereinbelow face 1*a* will be termed the top face, face 1*b* the bottom face, face 1*c* the right face, face 1*d* the left face, face 1*e* the front face, and face if the back face. The sides on which these faces 1*a* to 1*f* are located will be respectively termed the top face side, the bottom face side, the right face side, the left face side, the front face side, and the back face side.

On the bottom face 1*b* there is disposed a liquid delivery port 50 having a delivery hole for delivering ink to the ink-jet printer. Also, an air vent hole 100 for introducing air into the ink cartridge 1 opens onto the bottom face 1*b* (FIG. 6).

The air vent hole 100 has a depth and diameter such that a projection 230 (FIG. 7) that has been formed on the carriage 200 of the ink-jet printer will fit within it, with enough latitude to have a prescribed gap. The user will peel off a sealing film 90 that airtightly seals the air vent hole 100, then install the ink cartridge 1 on the carriage 200. The projection 230 is provided in order to prevent the user from forgetting to peel off the sealing film 90.

As depicted in FIGS. 3 and 4, a locking lever 11 is disposed on the left face 1*d*. A projection 11*a* is formed on the locking lever 11. During installation on the carriage 200, the projection 11*a* will lock in a recess 210 that has been formed on the carriage 200, thereby securing the ink cartridge 1 to the carriage 200 (FIG. 7). As will be appreciated from the above, the carriage 200 constitutes an installation portion on which the ink cartridges 1 are installed. During printing by the ink-jet printer, the carriage 200, in unison with the print head (not shown), undergoes reciprocating motion across the width of the printing medium in the main scanning direction. The main scanning direction is indicated by arrow AR1 in FIG. 7. Specifically, when the ink-jet printer carries out printing the ink cartridges 1 will be undergo reciprocating motion in the Y direction in the drawings.

A circuit board 34 is disposed to the lower side of the locking lever 11 on the left face 1*d* (FIG. 4). Several electric terminals 34 have been formed on the circuit board 34; these electric terminals 34 electrically connect to the ink-jet printer via electric terminal pins (not shown) provided on the carriage 200.

An outer surface film 60 is adhered to the top face 1*a* and the back face if of the ink cartridge 1.

The internal configuration and configuration of parts of the ink cartridge 1 will be described with reference to FIGS. 5 and 6. The ink cartridge 1 has a cartridge body 10, and a cover member 20 covering the front face side of the cartridge body 10.

Ribs 10*a* of various shapes have been formed on the front face side of the cartridge body 10 (FIG. 5). A film 80 that covers the front face side of the cartridge body 10 is positioned between the cartridge body 10 and the cover member 20. The film 80 is adhered carefully to the edge faces on the front face side of the ribs 10*a* of the cartridge body 10 so as to prevent gaps from forming. The ribs 10*a* and the film 80 serve to divide the interior of the ink cartridge 1 into a plurality of small chambers, for example, ink storage chambers and a buffer chamber. These chambers will be discussed in more detail later.

A differential pressure valve housing chamber 40*a* and a vapor-liquid separation chamber 70*a* are formed to the back face side of the cartridge body 10 (FIG. 6). The differential pressure valve housing chamber 40*a* houses a differential pressure valve 40, which includes a valve member 41, a spring 42, and a spring seat 43. A ledge 70*b* is formed on the inner wall that encloses the bottom face of the vapor-liquid separation chamber 70*a*, and a vapor-liquid separation membrane 71 is adhered to the ledge 70*b*; this arrangement in its entirety constitutes a vapor-liquid separation filter 70.

A plurality of grooves 10*b* are also formed to the back face side of the cartridge body 10 (FIG. 6). When the outer surface film 60 is disposed so as to cover substantially the entire back face side of the cartridge body 10, these grooves 10*b* will define various flow passages (discussed later) between the cartridge body 10 and the outer surface film 60, for example, flow channels through which ink and air may flow.

Next, the arrangement in the vicinity of the circuit board 34 mentioned earlier will be described. A sensor housing chamber 30*a* is formed to the lower face side of the right face of the cartridge body 10 (FIG. 6). The sensor housing chamber 30*a* houses a liquid level sensor 31 and a fastening spring 32. The fastening spring 32 fastens the liquid level sensor 31 by pushing it against the inside wall on the lower face side of the sensor housing chamber 30. An opening on the right face side of the sensor housing chamber 30 is covered by a cover member 33, and the circuit board 34 mentioned earlier is fastened to the outside face 33*a* of the cover member 33. The sensor housing chamber 30*a*, the liquid level sensor 31, the fastening spring 32, the circuit board 34, and a sensor flow passage forming chamber 30*b*, discussed later, will be referred to as the sensor section 30.

While not illustrated in detail, the liquid level sensor 31 includes a cavity that defines part of the intermediate flow passage (to be discussed later); an oscillating plate that defines part of the wall of the cavity; and a piezoelectric element arranged on the oscillating plate. The terminals of the piezoelectric element are connected electrically to some of the electric terminals of the circuit board 34; and with the ink cartridge 1 installed in the ink-jet printer, the terminals of the piezoelectric element will be electrically connected to the ink-jet printer via electric terminals of the circuit board 34. By applying electrical energy to the piezoelectric element, the ink-jet printer can induce oscillation of the oscillating plate through the agency of the piezoelectric element. The presence of any air bubbles in the cavity will be ascertained through subsequent detection, through the agency of the piezoelectric element, of a characteristic (frequency etc.) of residual vibration of the oscillating plate. Specifically, when due to consumption of the ink stored in the cartridge body 10, the state inside the cavity changes from an ink-filled state to an air-filled state, there will be a change in the characteristics of residual vibration of the oscillating plate. By detecting this change in characteristics of residual vibration via the liquid level sensor 31, the ink-jet printer detects whether ink is present in the cavity.

The circuit board 34 is provided with a rewritable nonvolatile memory such as EEPROM (Electronically Erasable and Programmable Read Only Memory), which is used to store parameters such as the amount of ink consumed by the ink-jet printer.

On the bottom face side of the cartridge body 10 there are disposed the liquid delivery port 50 and the air vent hole 100 mentioned previously, as well as a depressurization hole 110, a sensor flow passage forming chamber 30*b*, and a labyrinthine passage forming chamber 95*a* (FIG. 6). The depressurization hole 110 is utilized during injection of the ink in the ink cartridge 1 manufacturing process, in order to suck out air and depressurize the interior of the ink cartridge 1. The sensor flow passage forming chamber 30*b* and the labyrinthine passage forming chamber 95*a* constitute parts of the intermediate flow passage, discussed later. The sensor flow passage forming chamber 30*b* and the labyrinthine passage forming chamber 95*a* are the sections that are narrowest and have the highest flow resistance in the intermediate flow passage. In particular, the labyrinthine passage forming chamber 95 defines a flow passage of labyrinthine configuration, and produces a meniscus (a liquid bridge that forms in the flow passage), and therefore the flow resistance is particularly high in this section.

The openings of the liquid delivery port 50, the air vent hole 100, the depressurization hole 110, the labyrinthine passage forming chamber 95*a*, and the sensor flow passage forming chamber 30*b* will be respectively sealed off by sealing films 54, 90, 98, 95, 35 upon completion of manufacture of the ink cartridge 1. Of these, the sealing film 90 is intended to be peeled off by the user prior to installing the ink cartridge 1 in the carriage 200 as described earlier. By so doing, the air vent hole 100 will communicate with the outside, allowing air to be introduced into interior of the ink cartridge 1. The sealing film 54 is designed to be ruptured by an ink delivery needle 240 provided on the carriage 200 when the ink cartridge 1 is installed in the carriage 200 of the ink-jet printer.

In the interior of the liquid delivery port 50 are housed, in order from the lower face side, a seal member 51, a spring seat 52, and a blocking spring 53. When the ink delivery needle 240 has been inserted into the liquid delivery port 50, the seal member 51 will function to seal the gap between the inside wall of the liquid delivery port 50 and the outside wall of the ink delivery needle 240. The spring seat 52 is adapted to contact the inside wall of the seal member 51 and block off the liquid delivery port 50 when the ink cartridge 1 is not installed in the carriage 200. The blocking spring 53 is adapted to urge the spring seat 52 in the direction of contact with the inside wall of the seal member 51. When the ink delivery needle 240 is inserted into the liquid delivery port 50, the upper end of the ink delivery needle 240 will push up the spring seat 52 and create a gap between the spring seat 52 and the seal member 51 so that ink is delivered to the ink delivery needle 240 through this gap.

Figure 8:
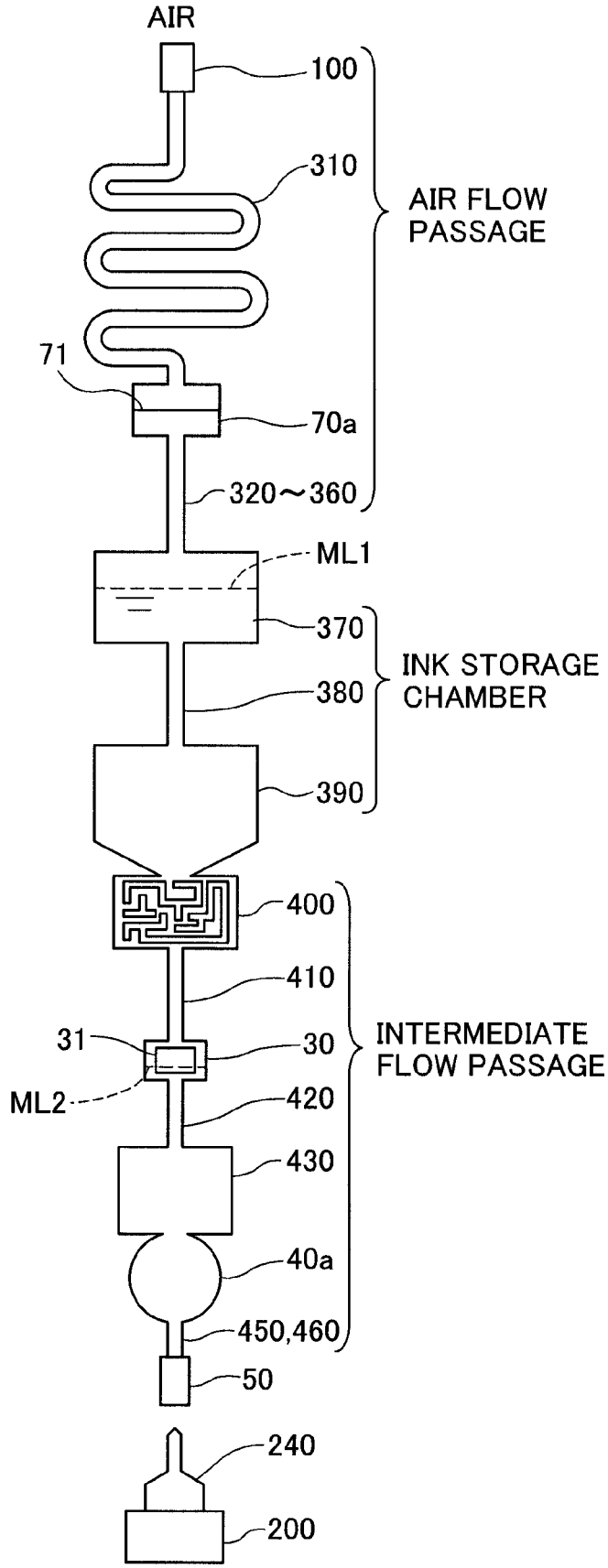
FIG. 8 is a diagram depicting conceptually the pathway leading from an air vent hole to a liquid delivery port.

Next, before proceeding to a more detailed description of the internal structure of the ink cartridge 1, for purposes of aiding understanding, the pathway leading from the air vent hole 100 to the liquid delivery port 50 will be described in conceptual terms with reference to FIG. 8. FIG. 8 is a diagram depicting conceptually the pathway leading from the air vent hole to the liquid delivery port.

The pathway leading from the air vent hole 100 to the liquid delivery port 50 will be broadly divided into ink storage chambers for holding ink, an air flow passage situated on the upstream side of the ink storage chambers, and an intermediate flow passage situated on the downstream side of the ink storage chambers.

The ink storage chambers include, in order from the upstream side, a first ink holding chamber 370, a holding chamber connector passage 380, and a second ink holding chamber 390. The upstream end of the holding chamber connector passage 380 communicates with the first ink holding chamber 370, while the downstream end of the holding chamber connector passage 380 communicates with the second ink holding chamber 390.

The air flow passage includes, in order from the upstream side, a serpentine passage 310, a vapor-liquid separation chamber 70*a* that houses the vapor-liquid separation membrane 71 discussed earlier, and connecting paths 320 to 360 that connect the vapor-liquid separation chamber 70*a* with the ink storage chamber. The serpentine passage 310 communicates at its upstream end with the air vent hole 100, and at its downstream end with the vapor-liquid separation chamber 70*a*. The serpentine passage 310 is elongated and extends in a sinuous configuration so as to maximize the distance from the air vent hole 100 to the first ink holding chamber 370. Through this arrangement, evaporation of moisture from the ink inside the ink storage chambers will be kept to a minimum. The vapor-liquid separation membrane 71 is constructed of material that permits vapor to pass, but does not allow liquid to pass. By situating the vapor-liquid separation membrane 71 between the upstream end and the downstream end of the vapor-liquid separation chamber 70*a*, ink backflowing from the ink storage chambers will be prevented from advancing upstream beyond the vapor-liquid separation chamber 70*a*. The specific configuration of the connecting paths 320 to 360 will be discussed later.

The intermediate flow passage includes, in order from the upstream side, a labyrinthine flow passage 400, a first flow passage 410, the aforementioned sensor section 30, a second flow passage 420, a buffer chamber 430, the aforementioned differential pressure valve housing chamber 40*a* housing the differential pressure valve 40, and third flow passages 450, 460. The labyrinthine flow passage 400 has a three-dimensional labyrinthine configuration and includes the space defined by the aforementioned labyrinthine passage forming chamber 95*a*. Through the labyrinthine flow passage 400, air bubbles entrained in the ink will be trapped so as to prevent air bubbles from being entrained in the ink downstream from the labyrinthine flow passage 400. The labyrinthine flow passage 400 is also termed an "air bubble trap flow passage." The first flow passage 410 communicates at its upstream end with the labyrinthine flow passage 400, and communicates at its downstream end with the sensor flow passage forming chamber 30*b* of the sensor section 30. The second flow passage 420 communicates at its upstream end with the sensor flow passage forming chamber 30*b* of the sensor section 30, and at its downstream end with the buffer chamber 430. The buffer chamber 430 communicates directly with the differential pressure valve housing chamber 40*a* with no intervening flow passage. Thus, the space from the buffer chamber 430 to the liquid delivery port 50 is minimized, and the likelihood of ink accumulating and settling out in that space will be reduced. In the differential pressure valve housing chamber 40*a*, through the action of the differential pressure valve 40, the pressure of the ink to the downstream side of the differential pressure valve housing chamber 40*a* will be maintained to be lower than the ink pressure on the upstream side, so that the ink in the downstream side assumes negative pressure. The third flow passages 450, 460 (see FIG. 9) communicate at the upstream side with the differential pressure valve housing chamber 40*a* and at the downstream side with the liquid delivery port 50. These third flow passages 450, 460 define vertical flow passages through which ink exiting the differential pressure valve housing chamber 40*a* will be guided vertically downward and into the liquid delivery port 50.

At the time of manufacture of the ink cartridge 1, the cartridge will be filled up to the first ink holding chamber 370, as indicated by the liquid level depicted conceptually by the broken line ML1 in FIG. 8. In the absence of an additional large-capacity ink tank 900 (FIGS. 1A, 1B, 2A, 2B), as the ink inside the ink cartridge 1 is consumed by the ink-jet printer the liquid level will move towards the downstream end and it will be replaced by air flowing into the ink cartridge 1 from the upstream end through the air vent hole 100. As ink consumption progresses, the liquid level will reach the sensor section 30 indicated by the liquid level depicted conceptually by the broken line ML2 in FIG. 8. At this point, air will enter the sensor section 30, and ink depletion will be detected by the liquid level sensor 31. Once ink depletion has been detected, the ink jet printer will halt printing and alert the user at a stage before the ink present to the downstream side of the sensor section 30 (in the buffer chamber 430 etc.) is completely consumed. This is because if the ink is totally depleted, when it is attempted to continue further printing there is a risk that air may be drawn into the print head and cause problems.

Figure 9:
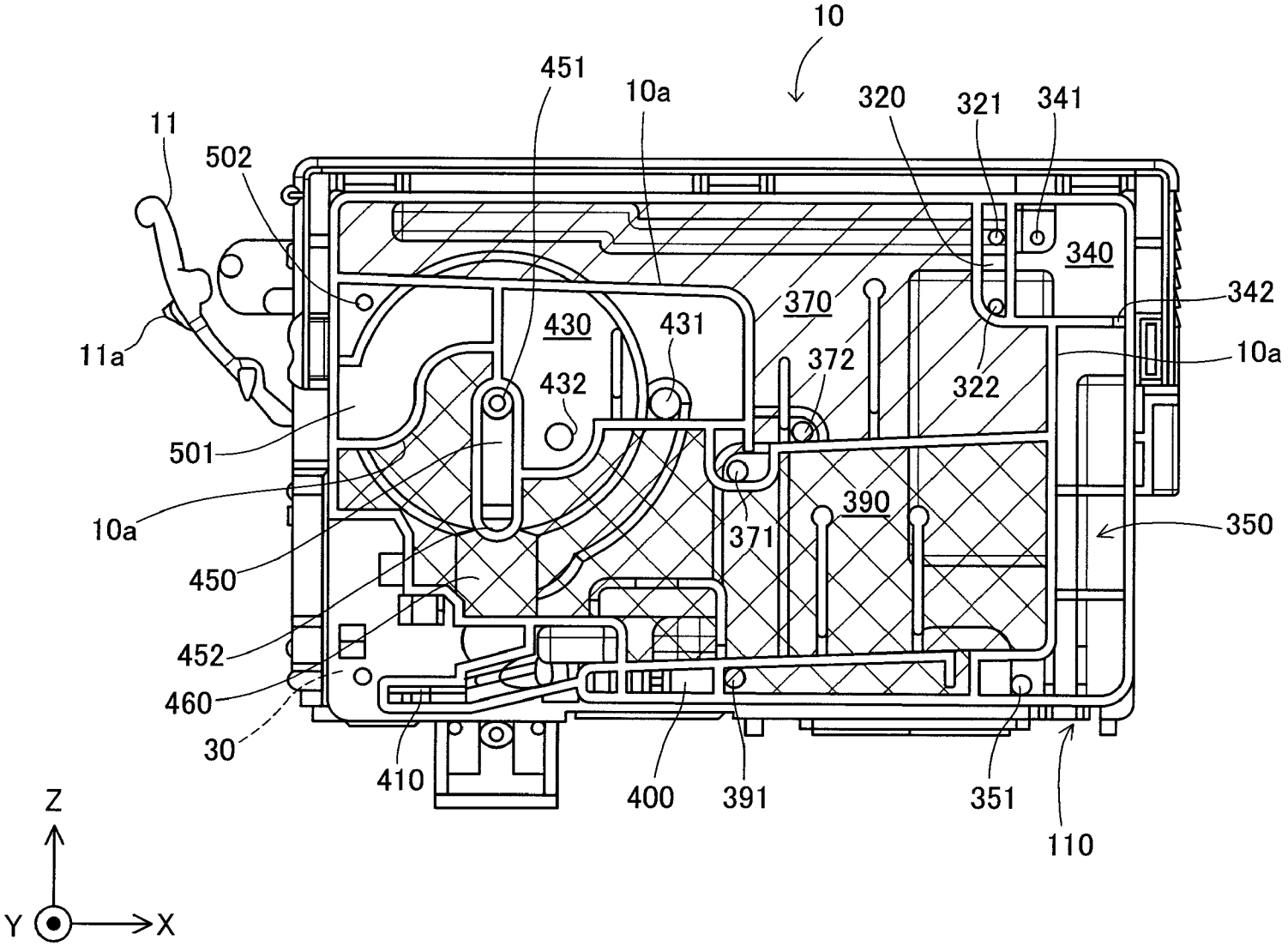
FIG. 9 is a drawing depicting a cartridge body from the front face side.
Figure 10:
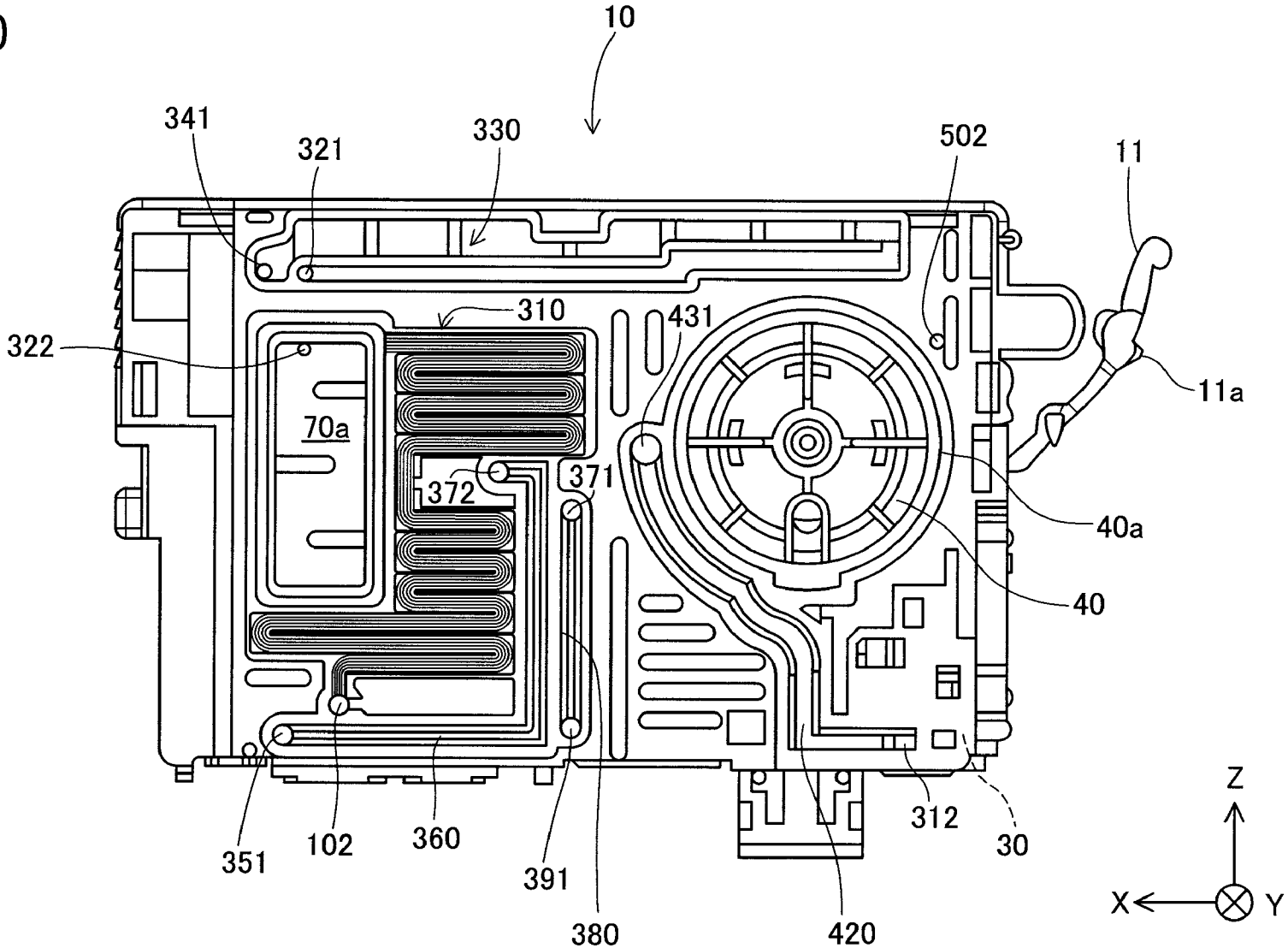
FIG. 10 is a drawing depicting a cartridge body from the back face side.
Figure 11A:
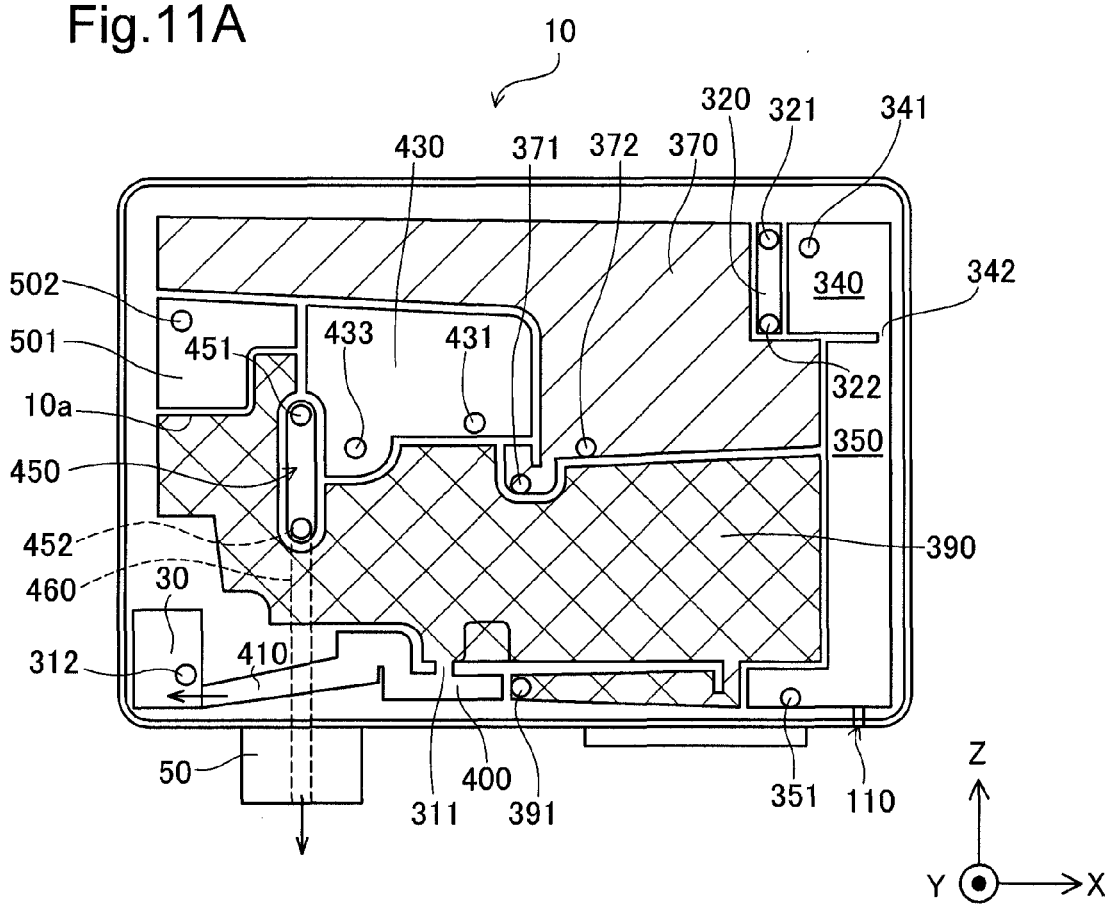
FIGS. 11A and 11B are diagrams of FIG. 9 and FIG. 10 in simplified form.
Figure 11B:
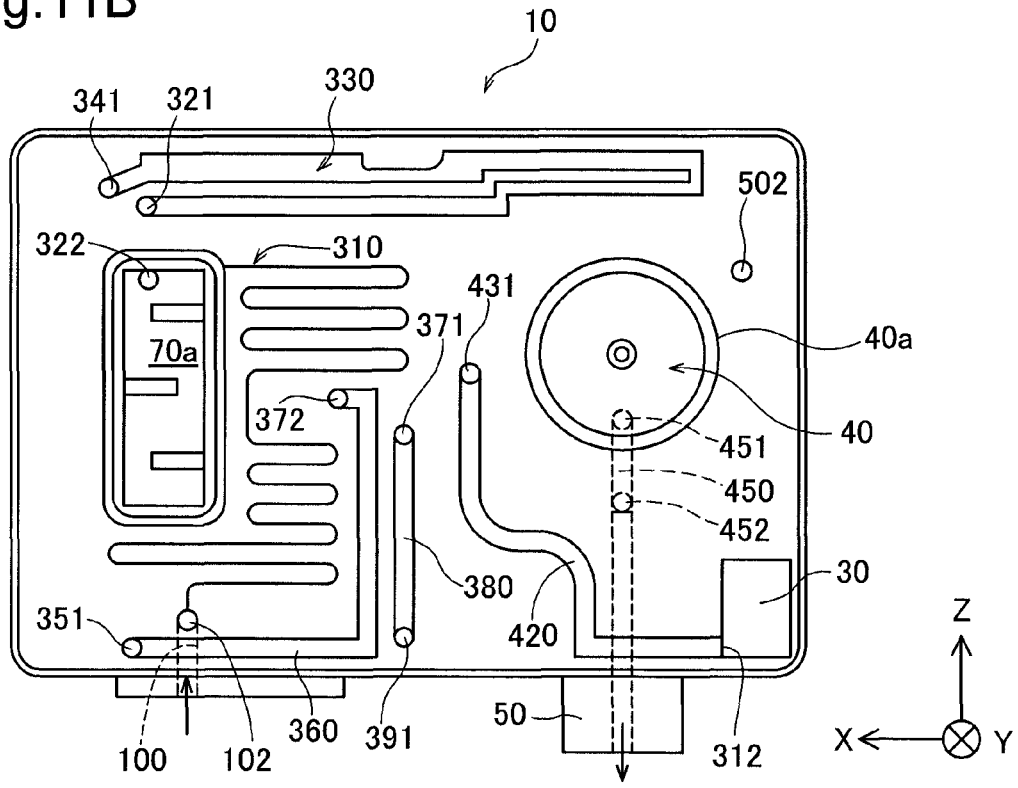

The specific configuration of each element on the pathway from the air vent hole 100 to the liquid delivery port 50 within the ink cartridge 1 will be described with reference to FIGS. 9 to 11B. FIG. 9 is a drawing depicting the cartridge body 10 from the front face side. FIG. 10 is a drawing depicting the cartridge body 10 from the back face side. FIG. 11A is a model diagram of FIG. 9 in simplified form. FIG. 11B is a model diagram of FIG. 10 in simplified form.

In the ink storage chambers, the first ink holding chamber 370 and the second ink holding chamber 390 are formed on the front face side of the cartridge body 10. In FIG. 9 and FIG. 11A, the first ink holding chamber 370 and the second ink holding chamber 390 are shown respectively by single hatching and crosshatching. The holding chamber connector passage 380 is formed on the back face side of the cartridge body 10, at the location shown in FIG. 10 and FIG. 11B. A communication hole 371 is provided to connect the upstream end of the holding chamber connector passage 380 with the first ink holding chamber 370, and a communication hole 391 is provided to connect the downstream end of the holding chamber connector passage 380 with the second ink holding chamber 390.

In the air flow passage, the serpentine passage 310 and the vapor-liquid separation chamber 70*a* are formed on the back face side of the cartridge body 10, at the respective locations shown in FIG. 10 and FIG. 11B. A communication hole 102 is provided to connect the upstream end of the serpentine passage 310 with the air vent hole 100. The downstream end of the serpentine passage 310 passes through the side wall of the vapor-liquid separation chamber 70*a* and communicates with the vapor-liquid separation chamber 70*a*.

Turning now to a more detailed description of the connecting paths 320 to 360 of the air flow passage depicted in FIG. 8, these are composed of a first space 320, a third space 340, and a fourth space 350 situated on the front face side of the cartridge body 10 (see FIG. 9 and FIG. 11A), and a second space 330 and a fifth space 360 situated on the back face side of the cartridge body 10 (see FIG. 10 and FIG. 11B), these spaces being situated in-line, in order of their assigned symbols from the upstream end, to define a single flow passage. A communication hole 322 is provided to connect the vapor-liquid separation chamber 70*a* to the first space 320. Communication holes 321, 341 are provided to connect the first space 320 with the second space 330, and the second space 330 with the third space 340, respectively. The third space 340 and the fourth space 350 communicate with one another through a notch 342 that has been formed in the rib separating the third space 340 and the fourth space 350. Communication holes 351, 372 are provided to connect the fourth space 350 with the fifth space 360, and the fifth space 360 with the first ink holding chamber 370, respectively.

In the intermediate flow passage, the labyrinthine flow passage 400 and the first flow passage 410 are formed on the front face side of the cartridge body 10 at the respective locations shown in FIG. 9 and FIG. 11A. A communication hole 311 is provided in the rib that separates the second ink holding chamber 390 from the labyrinthine flow passage 400, and connects the second ink holding chamber 390 with the labyrinthine flow passage 400. As discussed previously with reference to FIG. 6, the sensor section 30 is situated on the lower face side of the right face of the cartridge body 10 (FIGS. 9 to 11B). The second flow passage 420 and the aforementioned vapor-liquid separation chamber 70*a* are formed on the back face side of the cartridge body 10 at the respective locations shown in FIG. 10 and FIG. 11B. The buffer chamber 430 and the third flow passage 450 are formed on the front face side of the cartridge body 10 at the respective locations shown in FIG. 9 and FIG. 11A. A communication hole 312 is provided to connect the labyrinthine passage forming chamber 95*a* (FIG. 6) of the sensor section 30 with the second flow passage 420; and a communication hole 431 is provided to connect the downstream end of the second flow passage 420 with the buffer chamber 430. A communication hole 432 is provided to directly connect the buffer chamber 430 with the differential pressure valve housing chamber 40*a*. Communication holes 451,452 are provided to respectively connect the differential pressure valve housing chamber 40*a* with the third flow passage 450, and the third flow passage 450 with the ink delivery hole inside the liquid delivery port 50. As mentioned earlier, in the intermediate flow passage, the labyrinthine flow passage 400 and the sensor section 30 (the labyrinthine passage forming chamber 95*a* and the sensor flow passage forming chamber 30*b* of FIG. 5) are the sections of the flow passage in which flow resistance is highest.

A space 501 shown in FIG. 9 and FIG. 11A is an unfilled space that is not filled with ink. The unfilled space 501 is not situated on the pathway leading from the air vent hole 100 to the liquid delivery port 50, but is rather independent. An outside air communication hole 502 that communicates with the outside air is formed on the back face side of the unfilled space 501. The unfilled space 501 serves as a degassing space that is brought to negative pressure when the ink cartridge 1 is packaged in a vacuum pack. Thus, as long as the ink cartridge 1 is kept in the package, the inside pressure of the cartridge body 10 will be maintained below a prescribed pressure value so that the cartridge can deliver ink with negligible dissolved air.

Figure 12:
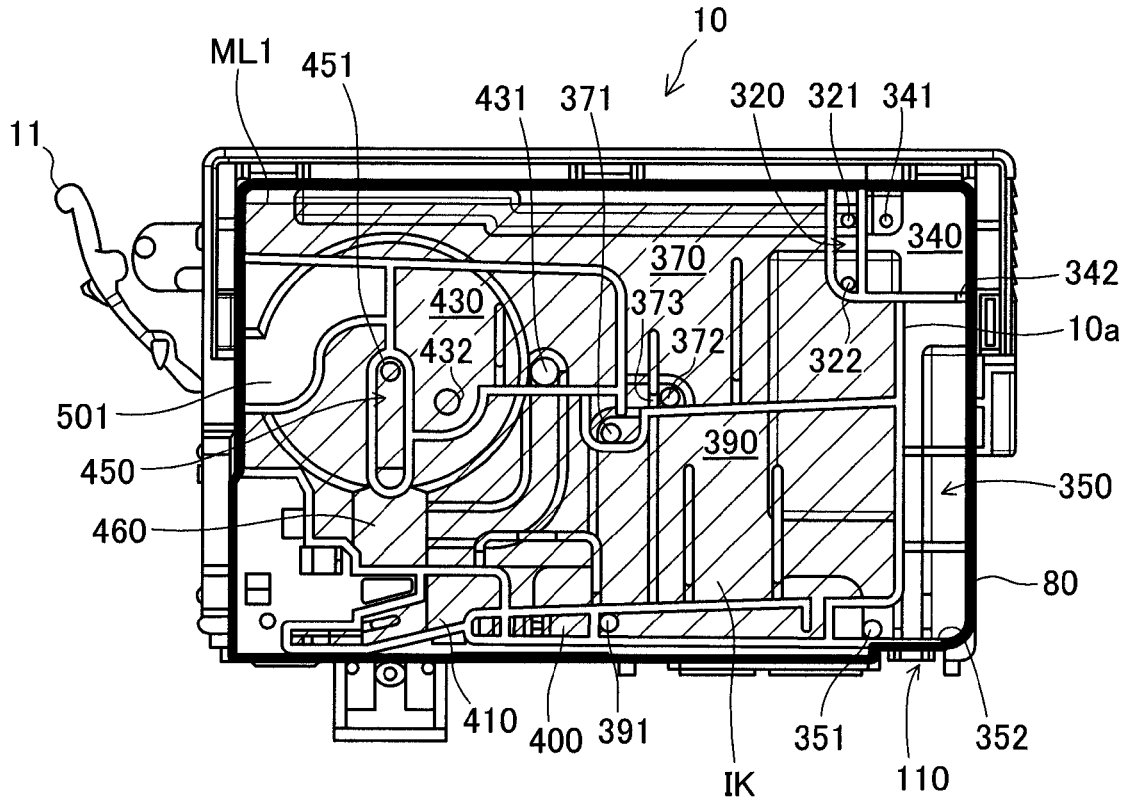
FIG. 12 illustrates an ink cartridge in the initial ink-filled condition.

FIG. 12 is an illustration depicting an ink cartridge in the initial ink-filled condition (factory condition). Here, the film 80 is shown joined along the wall edges indicated by the heavy solid line, and also joined on the other inner wall edges; the ink is held inside of these walls. A liquid level ML1 is shown here, and the section containing the ink IK is indicated by hatching. Specifically, of the ink storage chambers 370, 380, 390 (see FIG. 8), the liquid level ML1 will be situated in the upper part of the first ink holding chamber 370 which lies furthest towards the upstream end, with air being present above this level. Typically, as the ink in the cartridge is consumed, this liquid level ML1 will gradually drop. However, once the additional large-capacity ink tank 900 (FIGS. 1B, 2B) has been installed, there will be no change in liquid level in the ink cartridge.

Figure 13A:
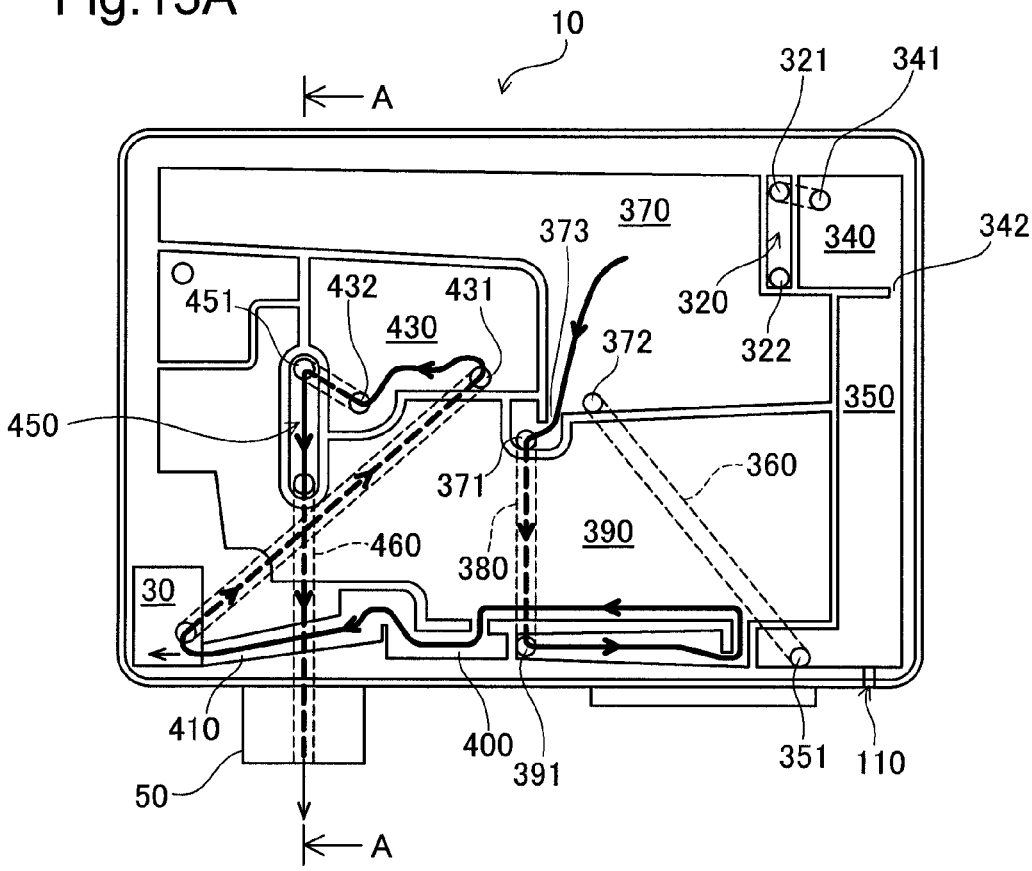
FIGS. 13A and 13B illustrate the flow of ink within an ink cartridge.
Figure 13B:
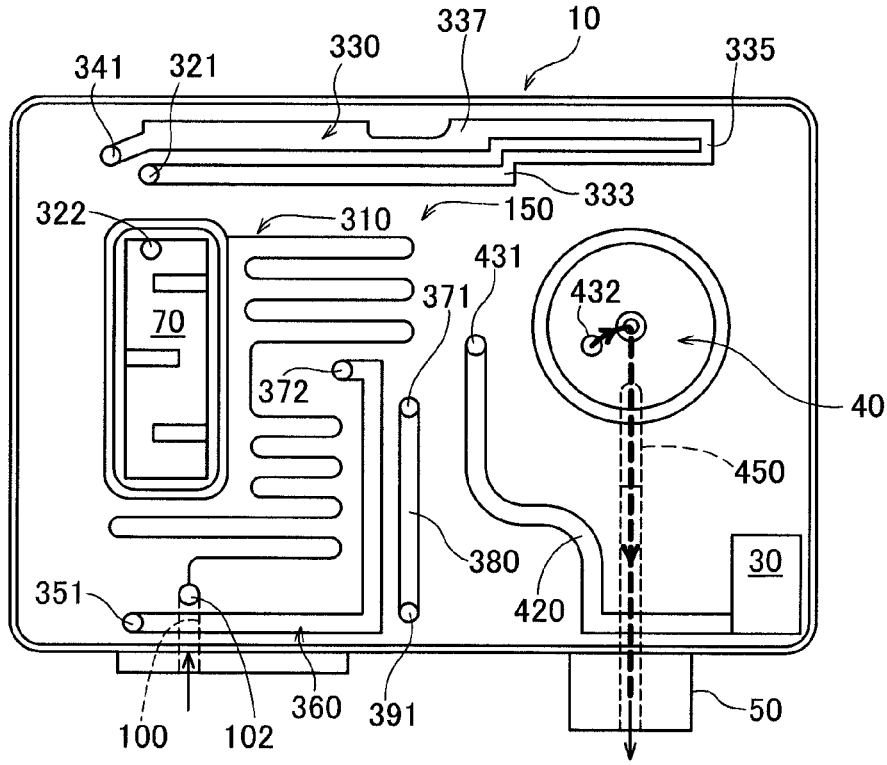

FIGS. 13A and 13B illustrate the flow of ink within an ink cartridge. Here, the ink flow path from the first ink holding chamber 370 to the liquid delivery port 50 is shown by thick solid lines and broken lines. This ink flow path can be understood as a more detailed rendering of the path through the ink storage chamber and the intermediate flow passage depicted in FIG. 8.

Figure 14A:
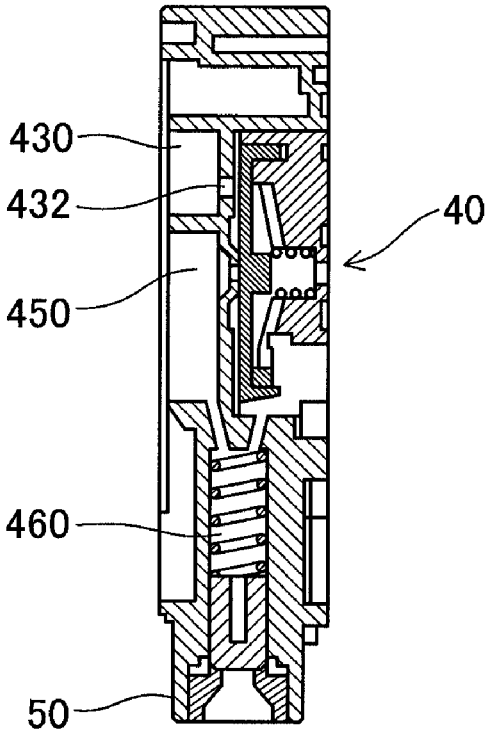
FIGS. 14A and 14B show the A-A cross section of FIG. 13A.
Figure 14B:
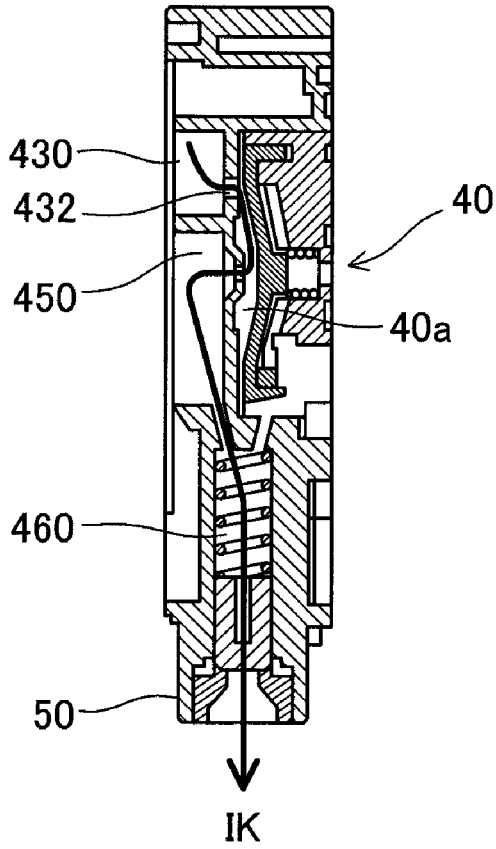

FIGS. 14A and 14B show the A-A cross section of FIG. 13A. The drawings depict the section that includes the differential pressure valve 40, the buffer chamber 430 at the upstream side of the differential pressure valve 40, and the vertical passages 450, 460 at the downstream side of the differential pressure valve 40. For convenience in illustration, the communication hole 432 that connects the buffer chamber 430 with the differential pressure valve chamber 40*a* is depicted as being at a location somewhat further towards the upper side than in FIG. 13A. FIG. 14A depicts the differential pressure valve 40 in the closed state. As the ink head consumes ink, the pressure on the liquid delivery port 50 side will drop and the differential pressure valve 40 will assume the open state as depicted in FIG. 14B. Once the differential pressure valve 40 opens, ink IK will flow from the buffer chamber 430 into the differential pressure valve housing chamber 40*a* through the communication hole 432, and thence through the vertical passages 450, 460 so that the ink IK is delivered from the liquid delivery port 50 to the print head. Utilizing the differential pressure valve 40, the delivery pressure of ink delivered to the print head will be maintained within an appropriate pressure range, whereby it is possible for ejection of ink from the print head to take place under stable conditions. As will be understood from the preceding discussion, the buffer chamber 430 is disposed to the immediate front of the differential pressure valve 40, and functions as a chamber for storing ink to be introduced into the differential pressure valve 40.

Figure 15A:
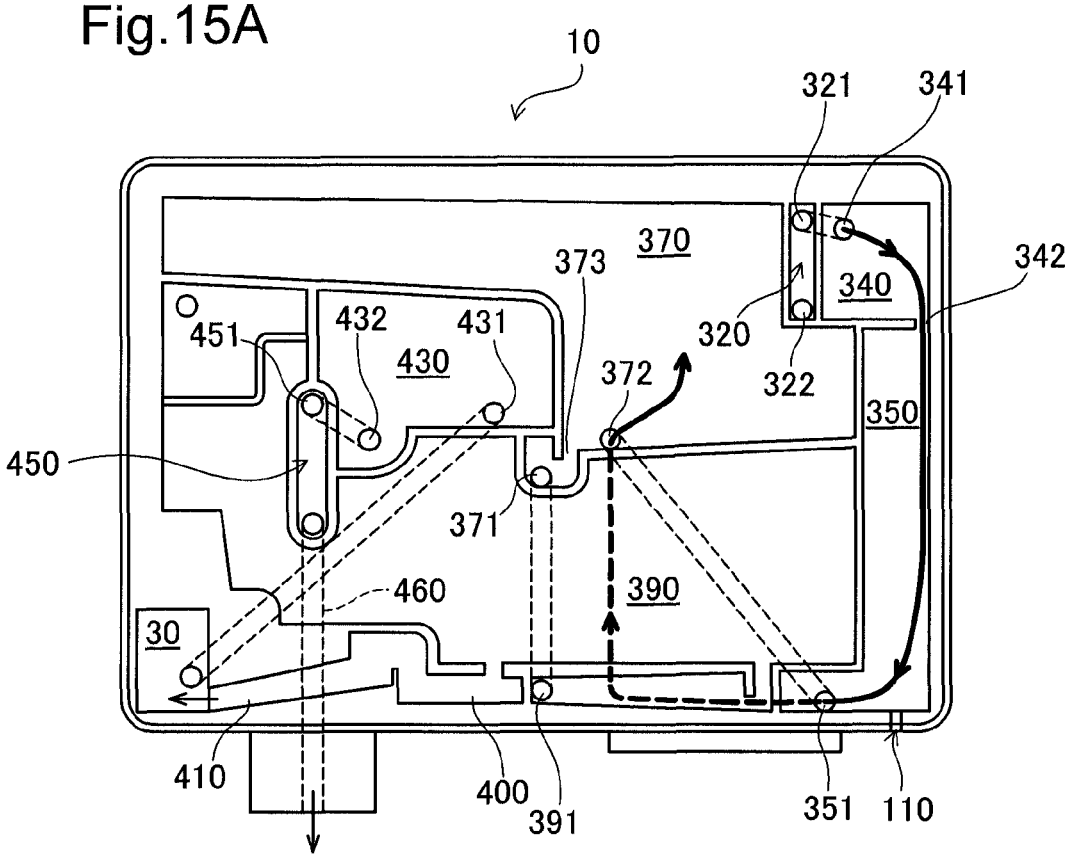
FIGS. 15A and 15B illustrate flow of air within an ink cartridge.
Figure 15B:
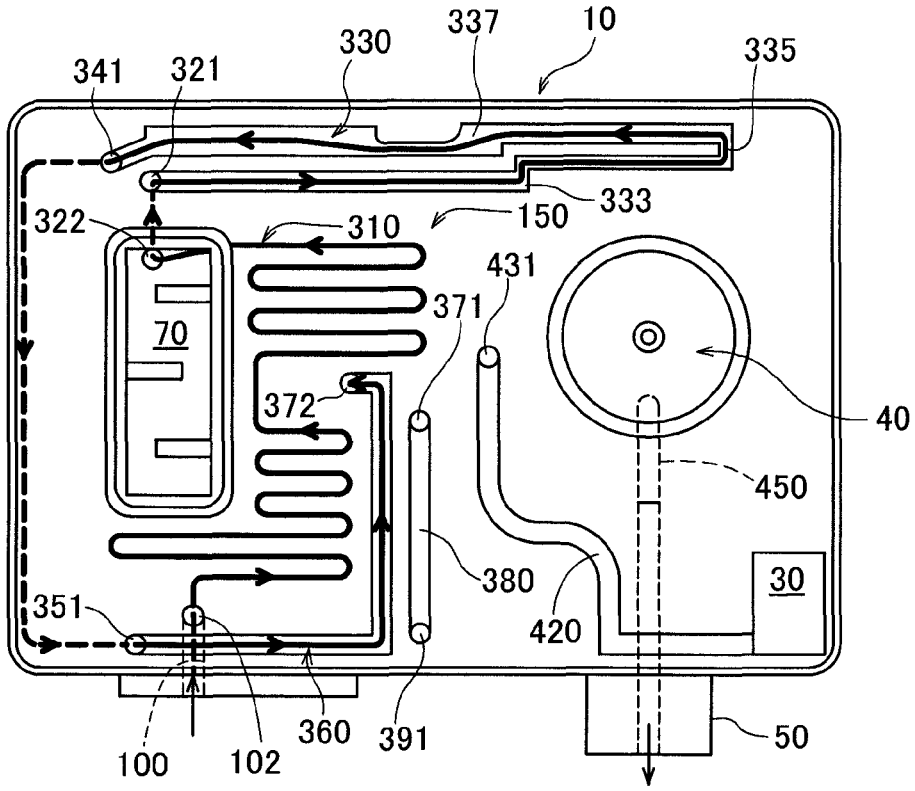

FIGS. 15A and 15B illustrate the flow of air within an ink cartridge. Here, the pathway of air flow from the air vent hole 100 (FIG. 15B) to the first ink holding chamber 370 is shown by thick solid lines and broken lines. This pathway of air flow can be understood as a more detailed rendering of the air flow path depicted in FIG. 8.

The discussion now turns to a method of manufacturing an ink delivery system (FIG. 1B, FIG. 2B) that employs the ink cartridge described above.

Figure 16:
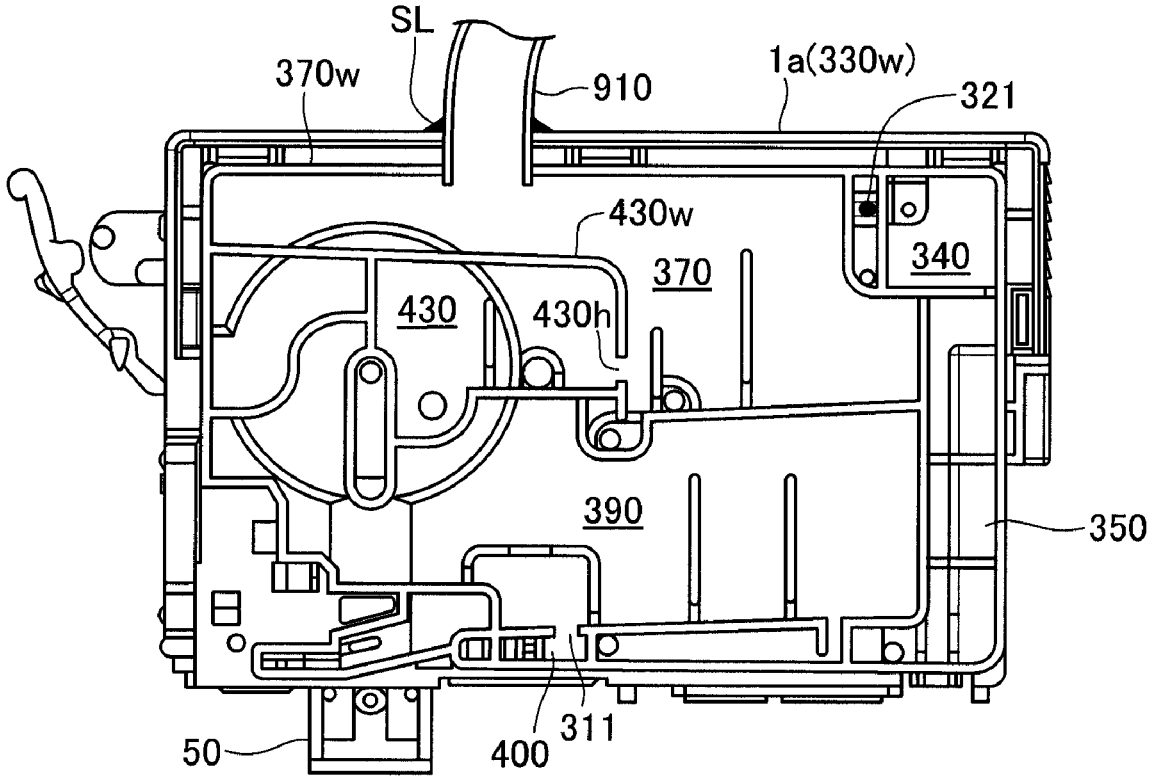
FIG. 16 shows a method of connecting an ink cartridge to an ink supply tube in Embodiment 1.

C. Configuration of Ink Cartridge for Use in Ink Delivery System and Method of Manufacturing the Same FIG. 16 shows a method of connecting an ink supply tube 910 to an ink cartridge in Embodiment 1. The ink supply tube 910 as an ink flow passage member is passed through the top face 1*a* of the cartridge and the wall 370*w* of the upper part of the first ink holding chamber 370, so as to connect with and open into the first ink holding chamber 370. A communication hole 430*h* is formed in the wall 430 between the first ink holding chamber 370 and the buffer chamber 430. Consequently, ink supplied from the large-capacity ink tank 900 (FIG. 1B) will be introduced into the buffer chamber 430 via the first ink holding chamber. In preferred practice the ink supply tube 910 will be made of flexible material.

The top face 1*a* of the cartridge in the section thereof through which the tube 910 passes also serves as the wall of the upper part of the second space 330 (see FIG. 15B) of the air flow passage which is situated to the back face side of the cartridge. Thus, hereinafter the top face 1*a* will also be referred to as "wall face 330*w*" in the sense that it is also the "wall of the second space 330*w*." As the second space 330 is the space situated uppermost in the vertical direction in the air flow passages 100 to 360 (see FIG. 8), it is also termed the "top air flow passage 330." Additionally, as the first ink holding chamber 370 represents the chamber situated uppermost in the vertical direction among the ink storage chambers 370 to 390, it is also termed the "top storage chamber 370."

The tube 910 connection operation is carried out by a procedure such as the following, for example. First, the ink cartridge and the tube 910 are prepared. The ink cartridge depicted in FIGS. 3 to 15A and various other cartridges are acceptable for this purpose. As depicted in FIG. 12, prior to connecting the tube 910, the ink holding chambers 370, 390 and the buffer chamber 430 of the cartridge are sealed by the film 80, with the cover member 20 sandwiching it from the outside (see FIG. 5). At this point, first, the cover member 20 will be detached, the film 80 will be partly or entirely peeled away, and holes will be made in wall faces 330*w* and 370*w* respectively. Also, the communication hole 430*h* will be made in the wall face 430*w*. Where the tube 910 is to be connected to the location shown in FIG. 16, it will be sufficient to peel off the sections of the film 80 covering the first ink holding chamber 370 and the buffer chamber 430, as it is possible to carry out the process without peeling the sections of the film 80 that cover the other chambers (the second ink holding chamber 390 etc.). The tube 910 is then passed through the holes in the wall faces 330*w*, 370*w* and fastened there. Fastening may be accomplished, for example, by applying an adhesive to the section of the tube 910 that will be pushed through the wall face 330*w*. This fastening operation will also form a seal part SL between the tube 910 and the wall face 330*w*. Sealing together of the tube 910 and the other wall face 370*w* of the upper part of the ink holding chamber 370 is optional. The communicating hole 321 in the air passage is then closed off by injecting a filler material into it. The reason for closing off the communicating hole 321 is to prevent outside air (air bubbles) introduced through the air vent hole 100 (see FIG. 15B) from flowing into the sensor section 30, possibly causing the sensor section 30 to malfunction. The peeled section of the film 80 is then reattached, the ink is replenished if necessary, and the cover part 20 is then attached. This series of operations completes the operation to connect the tube to the ink cartridge. By then connecting the tube 910 to the large-capacity ink tank 900, the ink delivery system is complete.

Figure 17:
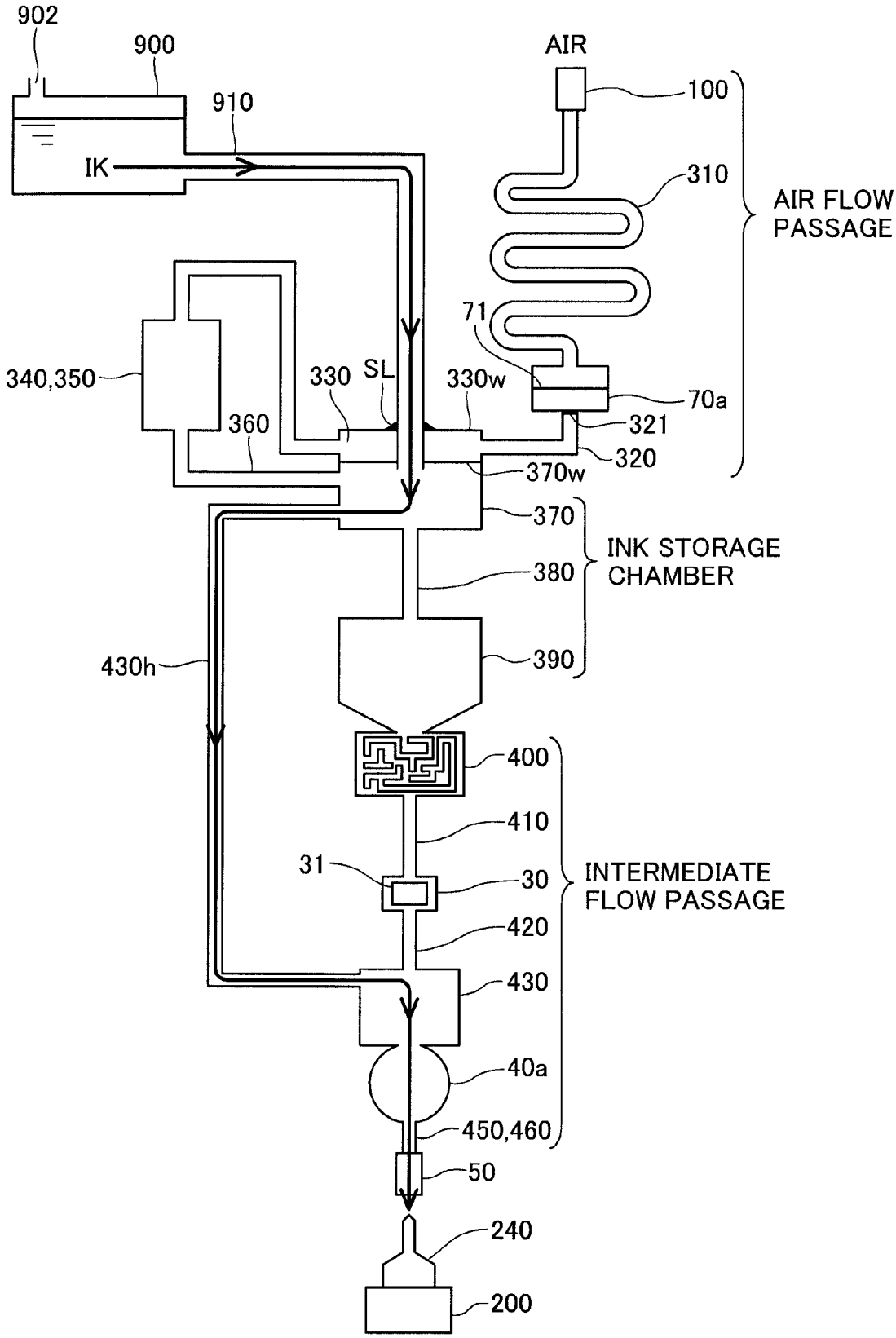
FIG. 17 is a conceptual depiction of an ink delivery system pathway in Embodiment 1.

FIG. 17 is a conceptual depiction of the ink delivery system pathway in Embodiment 1. In the drawing, the rendering of the air flow passage in the cartridge has been corrected somewhat, from that depicted in FIG. 8. Specifically, in FIG. 17, the top air flow passage 330 is depicted as being situated above the first ink holding chamber 370 (top storage chamber).

The large-capacity ink tank 900 has been connected to the first ink holding chamber 370 via the tube 910, and the first ink holding chamber 370 communicates with the buffer chamber 430 through the communication hole 430*h*. Consequently, ink IK supplied to the first ink holding chamber 370 from the large-capacity ink tank 900 will be delivered to the buffer chamber 430 while bypassing the second ink holding chamber 390, the labyrinthine flow passage 400, and the sensor section 30. In FIG. 17, for convenience of illustration, the communication hole 430*h* is depicted as being an elongated passage, but as depicted in FIG. 16 this communication hole 430*h* is actually just an opening formed in the wall face 430*w*. Typically, the large-capacity ink tank 900 will be provided with an air vent hole 902 as well so that air may be introduced into the large-capacity ink tank 900 in association with declining ink level. Consequently, it will be possible for ink to be fed to the buffer chamber 430 from the large-capacity ink tank 900 at a suitable pressure level at all times.

As mentioned earlier, the labyrinthine flow passage 400 and the sensor section 30 are ink flow passages of high flow passage resistance. An advantage of the present embodiment is that ink supplied from the large-capacity ink tank 900 need not pass through these ink flow passages 400, 30. If ink supplied from the large-capacity ink tank 900 were to pass through the ink flow passages 400, 30 in the course of being delivered to the print head of the printer, the flow resistance from the large-capacity ink tank 900 to the tube 910 may be compounded by the flow resistance of these ink flow passages 400, 30, with the possibility that sufficient ink may not be delivered to the print head. That is, as taught in the present embodiment, by supplying the ink to the buffer chamber 430 which is situated on the downstream side of the sensor section 30, it will be possible for ink to be delivered to the print head at appropriate pressure.

It should be noted that the buffer chamber 430 is present to the upstream side of the differential pressure valve housing chamber 40*a* that houses the differential pressure valve 40. Consequently, it will be possible for ink supplied through the tube 910 to be delivered to the print head at stable pressure conditions, by utilizing the function of the differential pressure valve 40.

In Embodiment 1, the tube 910 and the wall face 330*w* of the top air flow passage 330 are sealed together; and the communication hole 321 for outside air, which is situated on the upstream side of the top air flow passage 330 from the location at which the tube 910 passes through, is closed off. As a result, air (air bubbles) will not flow in from the air vent hole 100, and inflow of air to the sensor section 30 will be prevented. By so doing, it will be possible to avoid situations where inflowing air causes the sensor section 30 to mistakenly sense that no ink is present. It is possible for this closing off of the air flow passage to be done at any location to the upstream side of the tube 910 connection site.

According to Embodiment 1, because the ink supply tube 910 is connected to the first ink holding chamber 370, and a communication hole 430*h* has been provided between the first ink holding chamber 370 and the buffer chamber 430, ink supplied from the tube 910 will be delivered to the print head of the printer without passing through the sensor section 30, which represents an ink flow passage with high flow passage resistance. It will accordingly be possible to achieve stable ink delivery.

Figure 18:
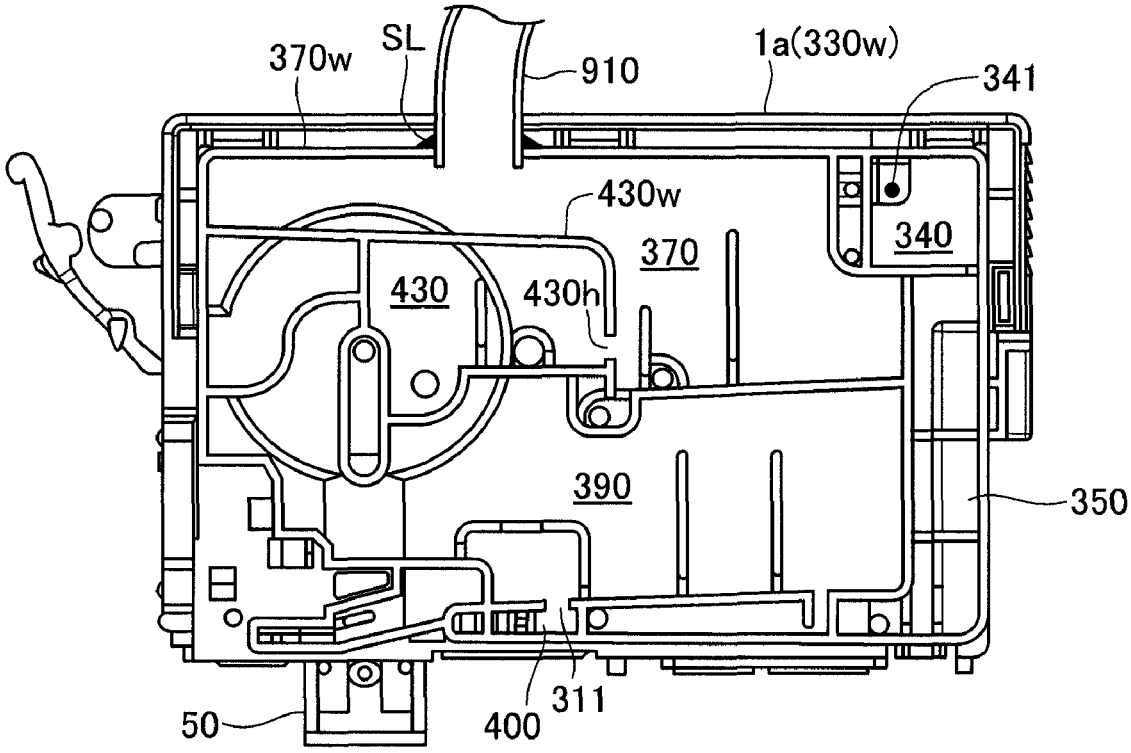
FIG. 18 shows a method of connecting an ink cartridge to an ink supply tube in Embodiment 2.

FIG. 18 shows a method of connecting an ink supply tube 910 to an ink cartridge in Embodiment 2. There are two differences from Embodiment 1 depicted in FIG. 16, namely, the location of the seal part SL between the cartridge and the tube 910, and the location at which the air flow passage is closed off; other configurations are the same as in Embodiment 1. Specifically, in Embodiment 2, the seal part SL between the cartridge and the tube 910 is disposed in the upper wall face 370*w* of the first ink holding chamber 370. The air flow passage is closed off at the communication hole 341, which is the inlet of the third space 340 disposed at the upper right of the cartridge.

Figure 19:
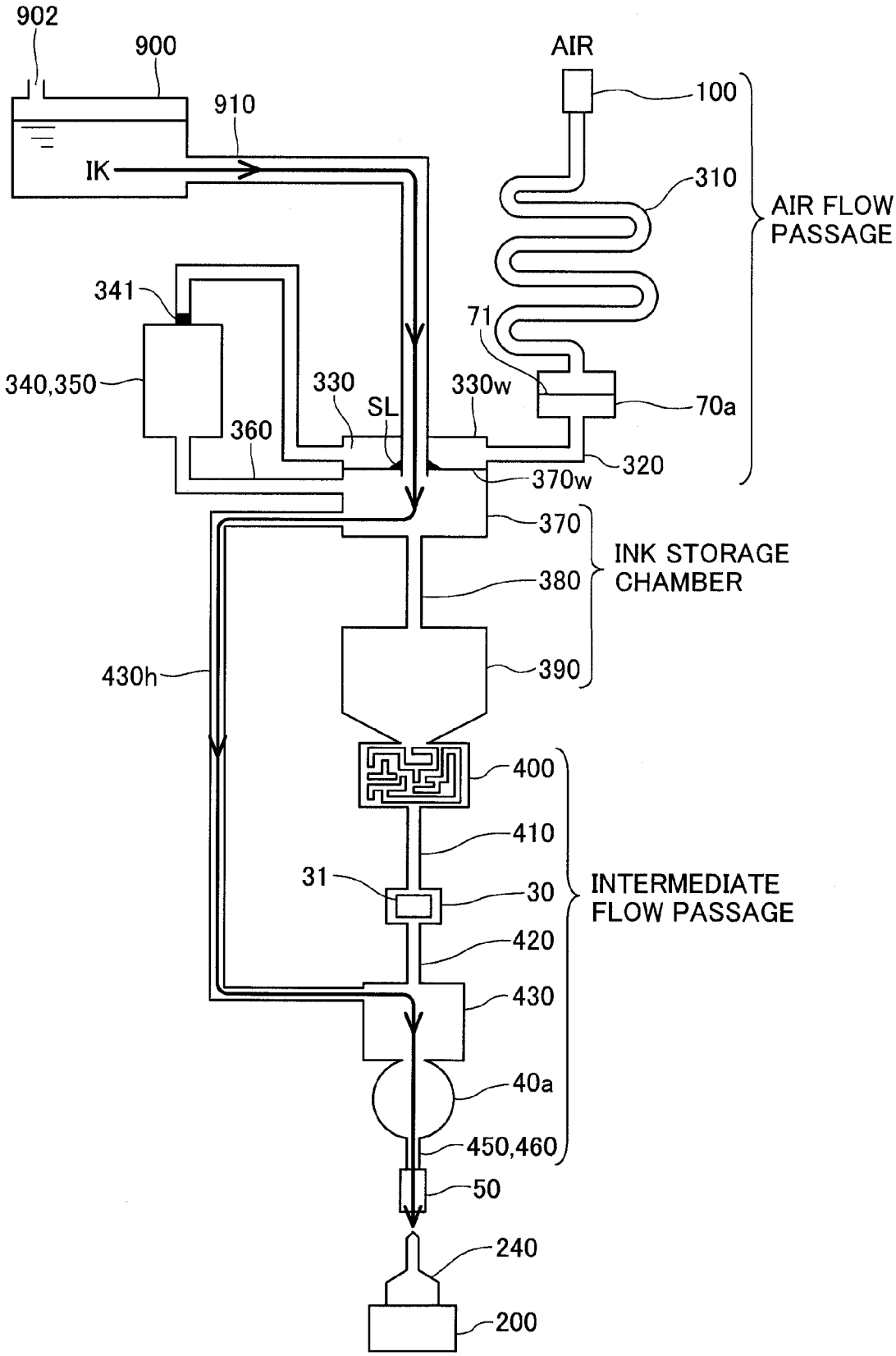
FIG. 19 is a conceptual depiction of an ink delivery system pathway in Embodiment 2.

FIG. 19 is a conceptual depiction of the ink delivery system pathway in Embodiment 2. The pathway of ink IK supplied from the large-capacity ink tank 900 is the same as in Embodiment 1. Consequently, as in Embodiment 1, it will be possible for ink supplied from the tube 910 to be delivered to the print head of the printer without passing through the sensor section 30 which represents an ink flow passage of high flow passage resistance, so that stable ink delivery will be achieved.

In Embodiment 2, the tube 910 and the wall face 370*w* of the first ink holding chamber 370 (top storage chamber) are sealed together; and the communication hole 341 for outside air situated on the downstream side from the location at which the tube 910 passes through is closed off. As a result, air (air bubbles) will not flow in from the air vent hole 100, and inflow of air to the sensor section 30 will be prevented. By so doing, it will be possible to avoid situations where inflowing air causes the sensor section 30 to mistakenly sense that no ink is present. In Embodiment 2, it is possible for this closing off of the air flow passage to be made at any location to the downstream side of the tube 910 connection site.

Figure 20:
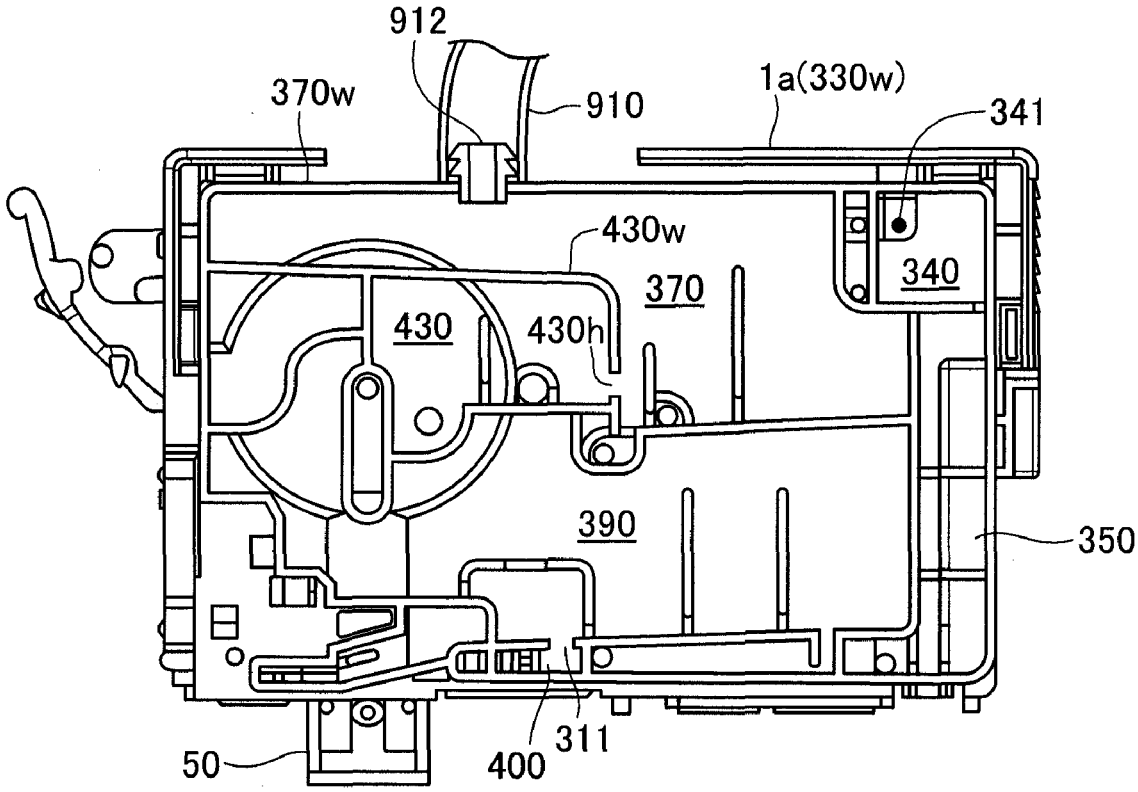
FIG. 20 shows a method of connecting an ink cartridge to an ink supply tube in Embodiment 3.

FIG. 20 shows a method of connecting an ink supply tube 910 to an ink cartridge in Embodiment 3. Embodiment 3 shares with Embodiment 2 the feature that the tube 910 is connected to and sealed with the upper wall face 370*w* of the first ink holding chamber 370, and that the air flow passage is closed off at the communication hole 341. Embodiment 3 differs from Embodiment 2 in the specific method of connection of the tube 910 to the wall face 370*w*. Specifically, in Embodiment 3, a coupling 912 has been mounted in the wall face 370*w*, and the tube 910 is slipped onto this coupling 912. Additionally, to facilitate mounting of the coupling 912 in the wall face 370, an area considerably larger than the contours of the tube 910 has been cut and removed from the top face 1*a* of the cartridge. In some instances, sufficient sealing together of the coupling 912 and the wall face 370 may be achieved simply through insertion of the coupling 912 through the wall face 370. However, more reliable sealing may be carried out using an adhesive or the like.

Embodiment 3 affords advantages comparable to Embodiment 2 discussed previously. Moreover, in Embodiment 3, because the tube 910 is connected using the coupling 912, there is the advantage of a simpler connection procedure. In particular, because the coupling 912 is attached to the wall face 370*w* inside the cartridge rather than to the top wall 1*a* of the cartridge, the coupling 912 will not hamper the installation of the cartridge into the cartridge housing (FIG. 7).

D. MODIFIED EXAMPLES

The present invention is not limited to the embodiments shown hereinabove, and may be reduced to practice in various other modes without departing from the spirit thereof, as in the possible modifications described below.

D1. Modified Example 1

While the preceding embodiments describe various flow passages, holding chambers, and communication holes provided to the ink cartridges, some of these arrangements may be dispensed with.

D2. Modified Example 2

While in the preceding embodiments, a large-capacity ink tank 900 is employed as the ink supply device, an ink supply device of some other configuration may be used. For example, it is possible to employ an ink supply device having a pump provided between the large-capacity ink tank 900 and the ink cartridge 1.

D3. Modified Example 3

While the preceding embodiments have described an ink delivery system adapted for an ink-jet printer, the present invention is adaptable generally to liquid delivery systems that deliver a liquid to a liquid jetting device or a liquid consuming device; with appropriate modifications, it is possible for the invention to be employed in liquid consuming devices of various kinds equipped with a liquid jetting head adapted to eject small amounts of a liquid in drop form. Herein, a drop refers to the state of the liquid ejected from the liquid jetting device, and includes those with tails of granular, teardrop, or filiform shape. Herein, a liquid refers to any material that can be jetted from a liquid jetting device. For example, substances of any state when in the liquid phase would be acceptable including those of a high- or low-viscosity liquid state, of a fluid state such as a sol, gel water, or other inorganic solvent, organic solvent, solution, liquid resin, liquid metal (molten metal), or substances having the liquid state as one of their states; as well as materials containing particles of functional materials consisting of solids such as pigments or metal particles dissolved, dispersed, or mixed into a medium. Typical examples of liquids are the inks described in the preceding embodiments, and liquid crystals. Here, the term "ink" is used to include typical water based inks and oil based inks, as well as shellac, hot melt inks, and various other kinds of liquid compositions. Specific examples of liquid consuming devices are liquid jetting devices adapted to jet liquids containing materials such as electrode materials or coloring matter in dispersed or dissolved form, and employed in manufacturing liquid crystal displays, EL (electroluminescence) displays, plane emission displays, or color filters; liquid jetting devices adapted to jet liquids containing bioorganic substances used in biochip manufacture; liquid jetting devices adapted to jet liquids as specimens for use as precision pipettes; textile printing devices; or microdispensers. The system may further be employed as a delivery system in liquid jetting devices used for pinpoint application of lubricants to precision instruments such as clocks or cameras; in liquid jetting devices adapted to jet an ultraviolet curing resin or other transparent resin solution onto a substrate for the purpose of forming a micro semi-spherical lens (optical lens) for use in optical communication elements etc.; or in liquid jetting devices adapted to jet an acid or alkali etchant solution for etching circuit boards etc. The present invention is adaptable as a delivery system to any of the above types of liquid jetting devices. The liquid delivery systems that deliver liquid other than ink will employ a liquid flow passage member made of material suitable for the particular liquid, in place of the ink supply tube.

What is claimed is:

1. A method of manufacturing a liquid delivery system that delivers liquid to a liquid jetting device, comprising the steps of:

(a) providing a liquid receptacle that is installable on the liquid jetting device;

(b) providing a liquid supply device that supplies the liquid receptacle with the liquid; and (c) connecting the liquid receptacle and the liquid supply device with a liquid flow passage member;

wherein the liquid receptacle has:

a liquid storage chamber that stores the liquid;

an air flow passage that connects the liquid storage chamber to an outside air;

a liquid delivery port that delivers the liquid to the liquid jetting device;

an intermediate flow passage leading from the liquid storage chamber to the liquid delivery port; and a sensor, disposed in the intermediate flow passage, for sensing whether the liquid is present or not, wherein the liquid storage chamber includes a top storage chamber which is located at an uppermost position in the liquid storage chamber, the intermediate flow passage has a buffer chamber disposed downstream of the sensor, at a location adjacent to the top storage chamber, the step (c) includes the steps of:

(i) connecting the liquid flow passage member to the top storage chamber; and (ii) forming a communication hole in a wall that lies between the top storage chamber and the buffer chamber.

2. The method according to claim 1, wherein the air flow passage includes a top air flow passage disposed adjacently above the top storage chamber, and the liquid flow passage member passes through an outside wall of the top air flow passage and through another wall between the top air flow passage and the top storage chamber, to connect with the top storage chamber.

3. The method according to claim 2, wherein the step (i) includes sealing together the outside wall of the top air flow passage and the liquid flow passage member, and the method further comprises closing off the air flow passage at a location upstream of a passing location where the liquid flow passage member passes through the top air flow passage.

4. The method according to claim 2, wherein the step (i) includes sealing together the liquid flow passage member, and a wall lying between the top air flow passage and the top storage chamber, and the method further comprises closing off the air flow passage at a location downstream of a passing location where the liquid flow passage member passes through the top air flow passage.

5. The method according to claim 4, wherein the step (i) includes:

cutting away a part of an outside wall of the top air flow passage such that the cut-away part is larger than a cross section of the liquid flow passage member;

forming an opening in a wall that lies between the top air flow passage and the top storage chamber;

fastening a coupling into the opening and sealing together the coupling and the opening; and connecting the liquid flow passage member to the coupling.

6. A liquid delivery system that delivers liquid to a liquid jetting device, comprising:

a liquid receptacle that is installable on the liquid jetting device;

a liquid supply device that supplies the liquid receptacle with the liquid; and a liquid flow passage member that connects the liquid receptacle with the liquid supply device, wherein the liquid receptacle has:

a liquid storage chamber that stores the liquid;

an air flow passage that connects the liquid storage chamber to an outside air;

a liquid delivery port that delivers the liquid to the liquid jetting device;

an intermediate flow passage leading from the liquid storage chamber to the liquid delivery port; and a sensor, disposed in the intermediate flow passage, for sensing whether the liquid is present or not, wherein the liquid storage chamber includes a top storage chamber which is located at an uppermost position in the liquid storage chamber, the intermediate flow passage has a buffer chamber disposed downstream of the sensor, at a location adjacent to the top storage chamber, the liquid flow passage member is connected to the top storage chamber, and a communication hole is formed in a wall that lies between the top storage chamber and the buffer chamber.

7. A method of manufacturing a liquid receptacle for use in a liquid delivery system that delivers liquid to a liquid jetting device, wherein the liquid receptacle is installable on the liquid jetting device and has:

a liquid storage chamber that stores the liquid;

an air flow passage that connects the liquid storage chamber to an outside air;

a liquid delivery port that delivers the liquid to the liquid jetting device;

an intermediate flow passage leading from the liquid storage chamber to the liquid delivery port; and a sensor, disposed in the intermediate flow passage, for sensing whether the liquid is present or not, the liquid storage chamber includes a top storage chamber which is located at an uppermost position in the liquid storage chamber, the intermediate flow passage has a buffer chamber disposed downstream of the sensor, at a location adjacent to the top storage chamber, wherein the method comprises the steps of:

connecting the liquid flow passage member to the top storage chamber; and forming a communication hole in a wall that lies between the top storage chamber and the buffer chamber.

* * * * *